US005642470A

United States Patent [19]

Yamamoto et al.

[11] Patent Number: 5,642,470

[45] Date of Patent: Jun. 24, 1997

[54] SINGING VOICE SYNTHESIZING DEVICE FOR SYNTHESIZING NATURAL CHORUS VOICES BY MODULATING SYNTHESIZED VOICE WITH FLUCTUATION AND EMPHASIS

[75] Inventors: Atsushi Yamamoto; Tatsuro Matsumoto, both of Kawasaki, Japan

[73] Assignee: Fujitsu Limited, Kawasaki, Japan

[21] Appl. No.: 310,788

[22] Filed: Sep. 27, 1994

[30] Foreign Application Priority Data

Nov. 26, 1993 [JP] Japan ..... 5-296324

[51] Int. Cl.[6] ..... G10L 3/00

[52] U.S. Cl. ..... 395/2.79; 395/2.67; 84/628; 84/629; 84/631; 84/633; 84/622

[58] Field of Search ..... 395/2.67, 2.7, 395/2.76, 2.79; 381/36–38, 40, 51–53; 84/609, 616, 622, 628, 629, 631, 633, 649, 654, 659, 664, 665, 681, 704, 706, 708, 711, 735, 740, 741, DIG. 4

[56] References Cited

U.S. PATENT DOCUMENTS 4,920,851 5/1990 Abe ..... 84/626

*Primary Examiner*—Kee M. Tung

*Attorney, Agent, or Firm*—Staas & Halsey

[57] ABSTRACT

Music information and word information are input to a music/word information input unit. A voice part extracting unit extracts note length information, pitch information, loudness information, and phonetic symbols from the music information and the word information for each voice part. A note length information changing unit changes the note length information extracted for each voice part. A pitch information changing unit changes the pitch information extracted for each voice part. Furthermore, a loudness information changing unit detects a solo in a chorus and changes the loudness information of the solo. A singing voice signal synthesizing unit provided for each voice part synthesizes a singing voice signal according to the note length information extracted and changed for each voice part, the pitch information extracted and changed for each voice part, the changed loudness information, and the phonetic symbols. A chorus signal generating unit generates a singing voice signal in a chorus from the singing voice signals synthesized for each voice part. A singing voice output unit generates singing voices of the chorus from the singing voice signals of the chorus and outputs them.

16 Claims, 35 Drawing Sheets

T110

FIG. 2A PRIOR ART

L8

| soprano | | alto | | tenor | | bass | |
|---|---|---|---|---|---|---|---|
| 04 | | 04 | | 03 | | 03 | |
| R | | R | | R | | R | |
| D | Let's | D | Let's | D | Let's | D | Let's |
| C# | run | C# | run | C# | run | C# | run |
| D | out | D | out | D | out | D | out |
| > | | > | | > | | > | |
| B-2 | now | B-2 | now | B-2 | now | B-2 | now |
| & | | & | | & | | & | |
| B- | | B- | | B- | | B- | |
| < | | < | | < | | < | |

FIG. 2B PRIOR ART

| | | | | | | | |
|---|---|---|---|---|---|---|---|
| F | To | F | To | F | To | F | To |
| E | green- | E | green- | E | green- | E | green- |
| F | er | F | er | F | er | F | er |
| D2. | fields | D2. | fields | D2. | fields | D2. | fields |
| D4 | Where | D4 | Where | D4 | Where | D4 | Where |
| E-4. | shines | E-4. | shines | E-4. | shines | E-4. | shines |
| B- | a | B- | a | B- | a | B- | a |
| A4 | splen- | A4 | splen- | A4 | splen- | A4 | splen- |
| G | di- | G | di- | G | di- | G | di- |
| A | d | A | d | A | d | A | d |
| F2 | sun | F2 | sun | F2 | sun | F2 | sun |
| & | | & | | & | | & | |
| F | | F | | F | | F | |

FIG. 3 PRIOR ART

| | | | |
|---|---|---|---|
| T110 | | F | To |
| L8 | | E | green- |
| soprano | | F | er |
| O4 | | D2. | fields |
| R | | D4 | Where |
| D | Let's | E-4. | shines |
| C# | run | B- | a |
| D | out | A4 | splen- |
| > | | G | di- |
| B-2 | now | A | d |
| & | | F2 | sun |
| B- | | & | |
| < | | F | |

FIG. 5 PRIOR ART

| | |
|---|---|
| Q | 272 |
| l | 16 |
| e | 156 |
| ts | 100 |
| r | 14 |
| Λ | 122 |
| n | 136 |
| au | 230 |
| t | 42 |
| n | 48 |
| au | 1312 |
| t | 71 |

| | |
|---|---|
| u | 201 |
| g | 68 |
| r | 13 |
| i | 123 |
| n | 68 |
| ə | 136 |
| r | 136 |
| f | 67 |
| i | 1512 |
| l | 20 |
| d | 33 |

.

.

.

$Z^{-1}$ : TIME LAG OF 1-SAMPLE CYCLE
$\alpha_1 \sim \alpha_P$ : PARCOR COEFFICIENT

AMPLITUDE A OF SOUND SOURCE: DEPENDS ON LOUDNESS INFORMATION

| | | | | | |
|---|---|---|---|---|---|
| BEFORE ADJUSTING NOTE LENGTH | SOPRANO | 250 | 250 | 250 | 250 |
| | ALTO | 250 | 250 | 250 | 250 |
| AFTER ADJUSTING NOTE LENGTH | SOPRANO | 252 | 249 | 245 | 254 |
| | ALTO | 253 | 250 | 245 | 252 |

SINGING VOICE SYNTHESIZING DEVICE FOR SYNTHESIZING NATURAL CHORUS VOICES BY MODULATING SYNTHESIZED VOICE WITH FLUCTUATION AND EMPHASIS

BACKGROUND OF THE INVENTION

1. Field of the Invention

The present invention relates to a singing voice synthesizing device for synthesizing a singing voice according to music information and word information.

2. Description of the Related Art

Chorus synthesizing devices have already been developed to synthesize a singing voice and then generate a chorus from synthesized singing voices by inputting words of a song and note information put down onto a musical score corresponding to the words. Described below are the related conventional technologies.

FIG. 1 shows an example of a musical score for a mixed 4-voice-part chorus. FIG. 2 shows the music information and the word information generated from the musical score shown in FIG. 1. The music information and the word information contain the information for four voice parts, that is, soprano, alto, tenor, and bass. The music information is entered in the description language called "MML (Music Macro Language)" for use in a music performance through a personal computer. For example, the pitch of C is represented by C, D by D, E by E, F by F, G by G, A by A, and B by B. The middle octave is specified by O, and higher and lower octaves are represented by > and < respectively. The timing is indicated by "8" for an eighth note, "2" for a half note, and "4" for a quarter note. Furthermore, it is indicated by "8." for a dotted eighth note, "4." for a dotted quarter note, and "2." for a dotted half note. The basic note is specified by "L" and the description of the timing can be omitted unless otherwise specified. For example, line 2 in FIG. 2 indicates "L8" to specify an eighth note as a basic note, and the description of "8" for the eighth note can be omitted afterwards. A sharp symbol is represented by "#" or "+", a flat symbol by "–", and a tie symbol by "&", Thus, note data are generated according to a musical score by appropriately combining the above listed rules. For example, an eighth note at Do is represented by "C", a quarter note at flatted Re is represented by "D-4", and a dotted half note at sharped Mi is represented by "E#2." As for word information, words of a song are provided for corresponding notes.

FIG. 3 shows the voice part for soprano extracted from the music and word information shown in FIG. 2. Likewise, the other voice parts alto, tenor, and bass can be extracted from the entire music and word information.

FIG. 4 shows phonetic symbols generated from the word information for soprano shown in FIG. 3. A phonetic symbol represents vowels or consonants of a voice sound separately.

FIG. 5 shows timing information generated from the music information of each voice part as shown in FIG. 3 and the phonetic symbols shown in FIG. 4. In the case of the song shown in FIG. 1, the tempo 110 indicates 60/110 second for a quarter note equal to approximately 545 ms based on which the timing is determined for the song. According to the timing information shown in FIG. 5, the first data "Q 272" indicates 272 ms for an eighth note equal to a half of 545 ms for a quarter note. The next "1 16" indicates 16 ms for the consonant "1" of the word "Let's" Then, "e 156" indicates 156 ms for the vowel "e" of the word "Let's", and the next "ts 100" indicates 100 ms for the consonant "ts" of that word. The word "let's" is assigned an eighth note according to the music information, and can be assigned 272 ms as a total of the vowel and the consonants. Thus, the timing information is obtained from the music information and provided for each phonetic symbol.

FIG. 6 shows the general configuration of the conventional singing voice signal generating device.

In FIG. 6, the music and word information as shown in FIG. 2 is input to a music/word input unit 1. A voice part extracting unit 2 extracts each voice part from the music and word information (FIG. 3 shows the information for soprano, and information can be extracted also for alto, tenor, and bass). The music and word information for each voice part is input to a corresponding singing voice signal synthesizing unit 3*a*, 3*b*, or 3*c* (although three singing voice signal synthesizing units are shown in FIG. 6, any number of required voice parts is actually accepted). A singing voice signal of each voice part is generated by singing voice signal synthesizing units 3*a*, 3*b*, and 3*c*. Each of the generated singing voice signals is applied to a chorus signal generating unit 4 for generating a chorus signal. The chorus signal generated by the chorus signal generating unit 4 is converted to an analog signal by a D/A converter not shown in FIG. 6, and then output as a chorus from a singing voice output unit 5 (for example, a speaker through an amplifier).

FIG. 7 shows in detail the configuration of the singing voice signal synthesizing unit 3. The singing voice signal synthesizing unit 3 comprises a rhythm information generating unit 31 and a singing voice signal generating unit 32.

FIG. 8 shows in detail the configuration of the rhythm information generating unit 31. The rhythm information generating unit 31 comprises a phonetic symbol generating unit 311, a note timing generating unit 312, a pitch information generating unit 313, and a loudness information generating unit 314. The phonetic symbol generating unit 311 divides a voice sound into vowels and consonants after representing a word of a song by phonetic symbols according to word information as shown in FIG. 4. The note length generating unit 312 generates a phoneme length based on music information and phonetic symbols as shown in FIG. 5.

Described below is the operation of generating note length information and a phoneme length by referring to the operational flowchart shown in FIG. 13.

1) First, a tempo symbol is extracted from music information. A tempo symbol represents the tempo of a performance. "Tl10" in line 1 of the music information shown in FIG. 2 indicates that the performance is given at the tempo of 110 quarter notes per minute. That is, the length of the quarter note is 60/110 second equal to 545 ms (step S 101).

2) Next, a note is checked in the music information. A note indicates the length in music information. For example, a quarter note, a dotted half note, etc. are commonly used (step S 102).

3) Then, generated is the relative length of a note in music information. For example, if a basic note is a quarter note as a tempo symbol, an eighth note indicates a half length of the basic note, and a half note indicates a double length of the basic note (step S 103 ).

4) A note timing is obtained according to a relative timing of a note. Since the basic note length is a quarter note of 545 ms, an eighth note indicates 272 ms, and a half note indicates 1090 ms (step S 104).

5) The timing of phonemes is generated from a generated note length. The length of a consonant and a vowel is generated according to predetermined rules. A note length is obtained by adding the length of a vowel and that of a consonant. For example, an eighth note for the word "Let's" is set to 16 ms for the consonant "l", 156 ms for the vowel "e", and 100 ms for "ts", that is, a total of 272 ms (step S 105).

The length of a phoneme of vowels, consonants, etc. can be obtained from the music information and the word information by repeating the above described processes. Then, the information is stored.

Next, FIG. 9 shows the configuration of the pitch information generating unit 313. In FIG. 9, the pitch information generating unit 313 comprises a basic pitch generating unit 3131, a portamento generating unit 3132, and a vibrato generating unit 3133.

Described below is the operation of the basic pitch generating unit 3131 by referring to the operational flowchart shown in FIG. 14.

1) First, the name of a musical pitch is extracted from the music information shown in FIG. 2, and a fundamental frequency is uniquely obtained using the name of the musical pitch (step S 201).

2) A fundamental frequency is obtained using a pitch name. A fundamental frequency corresponding to each pitch name in music information is preliminarily set in a conversion table, and a fundamental frequency corresponding to a pitch name is selected (step S 202).

3) According to a note length generated by the note length generating unit 312, a fundamental frequency pattern is generated for the length (step S 203).

The frequency pattern generated by repeating the above described processes according to music information is shown in FIG. 12A as a fundamental frequency pattern. Since each fundamental frequency discontinuously changes at this stage, the synthesized chorus sounds mechanical and unnatural as is.

Therefore, the portamento generating unit 3132 shown in FIG. 9 adjusts the fundamental frequency pattern shown in FIG. 12A into the one shown in FIG. 12B by adding a kind of a portamento (a smooth movement from a sound to another sound having a different pitch) so that the discontinuous portions in the fundamental frequency pattern generated by the basic pitch generating unit 3131 is adjusted into a continuous pattern and the fundamental frequency forms a smooth line.

FIG. 10 shows the configuration of the portamento generating unit 3132. The portamento generating unit 3132 comprises a portamento parameter 31321, portamento generation rules 31322, and a portamento processing unit 31323.

Described below is the operation of adding a portamento by the portamento processing unit 31323 by referring to the operational flowchart shown in FIG. 15.

1) First, it is determined whether or not a change has been made to a fundamental frequency. A change in a fundamental frequency refers to a discontinued portion of a fundamental frequency pattern in FIG. 12A. A process terminates if no change has been made to a fundamental frequency, and proceeds to its next step if any change has been made to the fundamental frequency (step S 301).

2) The portamento parameter 31321 is retrieved. If a fundamental frequency is changed to another fundamental frequency, then a parameter indicating, for example, the degree of portamento, time taken for adding portamento should be changed depending on the difference between the frequencies. The parameter is retrieved in this step (step S 302).

3) A section of portamento is obtained according to the portamento generation rules 31322. The portamento generation rules 31322 refer to predetermined rules such as functions. Using a portamento parameter retrieved in the previous step, it is obtained as to how much time is taken for portamento before and after a change in a fundamental frequency (step S 303).

4) A fundamental frequency for a portamento section is generated using the portamento generation rules 31322. A fundamental frequency can be obtained such that a smooth change can be made in the portamento section obtained in the previous step. Then, control is returned to step S 301 (step S 304).

FIG. 12B shows the fundamental frequency pattern obtained after adding portamento generated by repeating the above listed processes.

Next, vibrato is added as follows to the fundamental frequency pattern including the portamento as described above.

FIG. 11 shows the configuration of the vibrato generating unit 3133. The vibrato generating unit 3133 comprises a vibrato parameter 31331, vibrato generation rules 31332, and a vibrato processing unit 31333.

The operation of the vibrato processing unit 31333 is described below by referring to the operational flowchart shown in FIG. 16.

1) It is determined whether or not there is a section in which a fundamental frequency indicates a constant value. If no, the process terminates. If yes, control is passed to the next step S 402 (step S 401).

2) It is determined whether or not the constant section length is larger than a predetermined threshold length. If yes, control is passed to the next step. If no, control is returned to step S 401 (step S 402).

3) The vibrato parameter 31331 is retrieved. The vibrato parameter indicating vibrato which originally is a modulated frequency periodically provides a constant fundamental frequency with some hertz of frequency modulation, and the parameter refers to a modulated frequency, the amplitude of a modulation signal, etc. (step S 403).

4) A vibrato signal is generated according to the vibrato generation rules 31332. The vibrato generation rules 31322 are used in regulating a modulated frequency which is a vibrato signal for use in adding vibrato, the amplitude of a modulation signal, etc. (step S 404).

5) Thus, vibrato is added to a constant-fundamental frequency according to a vibrato signal, that is, a modulation signal. Then, control is returned to S 401 after the adding process (step S 405).

By repeating the above listed processes, the fundamental frequency pattern provided with portamento as shown in FIG. 12B is further provided with vibrato to form a fundamental frequency pattern shown in FIG. 12C.

The loudness information generating operation of the loudness information generating unit 314 shown in FIG. 8 is explained below by referring to the operational flowchart shown in FIG. 17.

1) A loudness symbol indicates the intensity of sound such as piano, forte, etc., and is retrieved from music information (step S 501).

2) The loudness adjustment amount corresponding to the retrieved loudness symbol is retrieved from a conversion table (step S 502).

3) The loudness adjustment start timing and the time taken for the adjustment is retrieved from music information. At the same time, the loudness adjustment amount obtained in the previous step is added to or subtracted from a reference loudness for a predetermined time (step S 503).

A singing voice signal generating unit 32 shown in FIG. 7 generates a singing voice from the fundamental frequency, loudness information, note length information, and phonetic symbols. For example, the unit can be a voice synthesizing device operated by a PARCOR method. The singing voice signals generated by the singing voice signal generating units 32 of singing voice signal synthesizing units 3*a*, 3*b*, and 3*c* of respective voice parts are added up in the chorus signal generating unit 4, output to the singing voice output unit 5, and then output as singing voices from the singing voice output unit 5 (for example, a speaker through an amplifier).

With the conventional singing voice synthesizing device, the change in a fundamental frequency of each voice part forming a chorus is made to be smooth, not discontinuous as shown in FIG. 12A to obtain a natural sound of a chorus. That is, a musical sound signal of a singing voice in a chorus is provided with kinds of portamento and vibrato as described above.

However, when the above mentioned portamento and vibrato are provided, the generation parameters and rules of the portamento and vibrato are common to all voice parts and therefore respective voice parts are provided with the same portamento and vibrato.

Furthermore, since the note length is common to all voice parts when control is passed from a note of a pitch to the next note of another pitch, the singing voice of each voice part proceeds to the next note at completely the same timing.

Each voice part is provided with vibrato having the same parameter. The vibrato does not provide an irregular frequency fluctuation normally detected in a singing voice, but is a simple frequency modulation in which a musical sound signal of a singing voice having a constant pitch is modulated with a modulation frequency of a few hertz.

Furthermore, if a single voice part gives a performance in a chorus, the loudness of the voice part is made the same as that of a normal chorus. Then, the single voice part performance gives the impression of insufficient loudness compared with a normal chorus and sounds insufficient in loudness.

As a result, a synthesized singing voice sounds unnatural and different from a live chorus.

SUMMARY OF THE INVENTION

An object of the present invention is to realize a singing voice synthesizing device capable of synthesizing natural singing voices.

The present invention provides a singing voice synthesizing device for synthesizing a singing voice from music and word information, and synthesizes a chorus performance with a natural sound.

According to the present invention, the information about the length of a note, pitch, and loudness is separately managed for each voice part. A pronunciation symbol of a word is extracted from word information. Vowels and consonants of a phonetic symbol of a pronunciation symbol, along with time information about the phonetic symbol are extracted for each voice part.

The divided note length is amended separately for each voice part and controlled such that all voice parts do not proceed to the next notes at the same time.

When portamento and vibrato are added to a musical sound signal of a singing voice generated from an extracted pitch, they are controlled not to be common to respective voice parts.

When a musical sound of each voice part is provided with vibrato, an irregular change in fundamental frequency is provided in addition to the vibrato indicating a regular change in the fundamental frequency.

Furthermore, when a single voice part gives a performance in a chorus, the loudness of the single voice part is larger than that of performances by more than one voice part.

BRIEF DESCRIPTION OF THE DRAWINGS

One skilled in the art can easily understand additional features and objects of this invention from the description of the preferred embodiments and some of the attached drawings. In the drawings:

FIG. 2 shows music and word information;

FIG. 3 shows the music and word information for soprano after being extracted from the entire score;

FIG. 5 shows the time information of vowels and consonants of words of the example;

DESCRIPTION OF THE PREFERRED EMBODIMENTS

Figure 1:
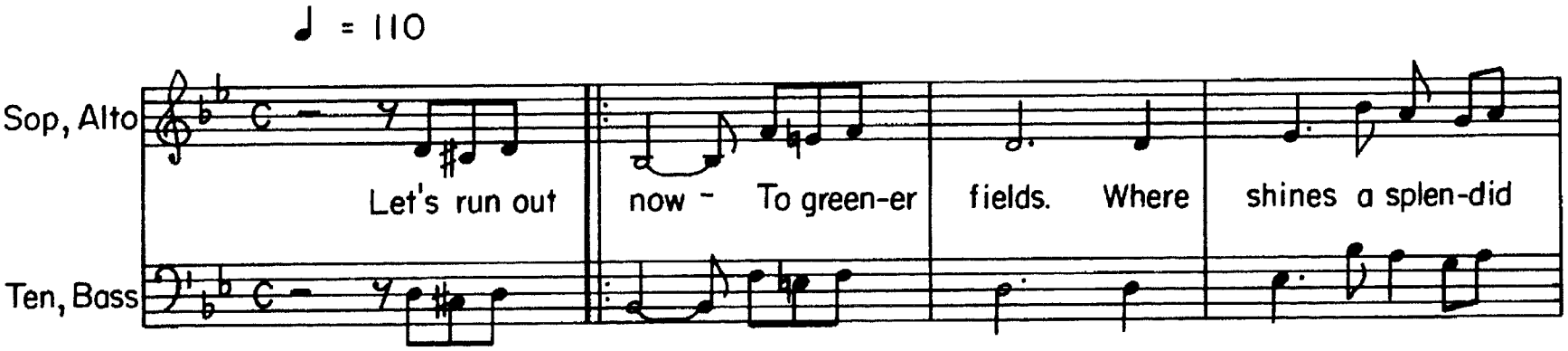
FIG. 1 PRIOR ART
FIG. 1 shows an example of a musical score for a mixed 4-part chorus.
Figure 4:
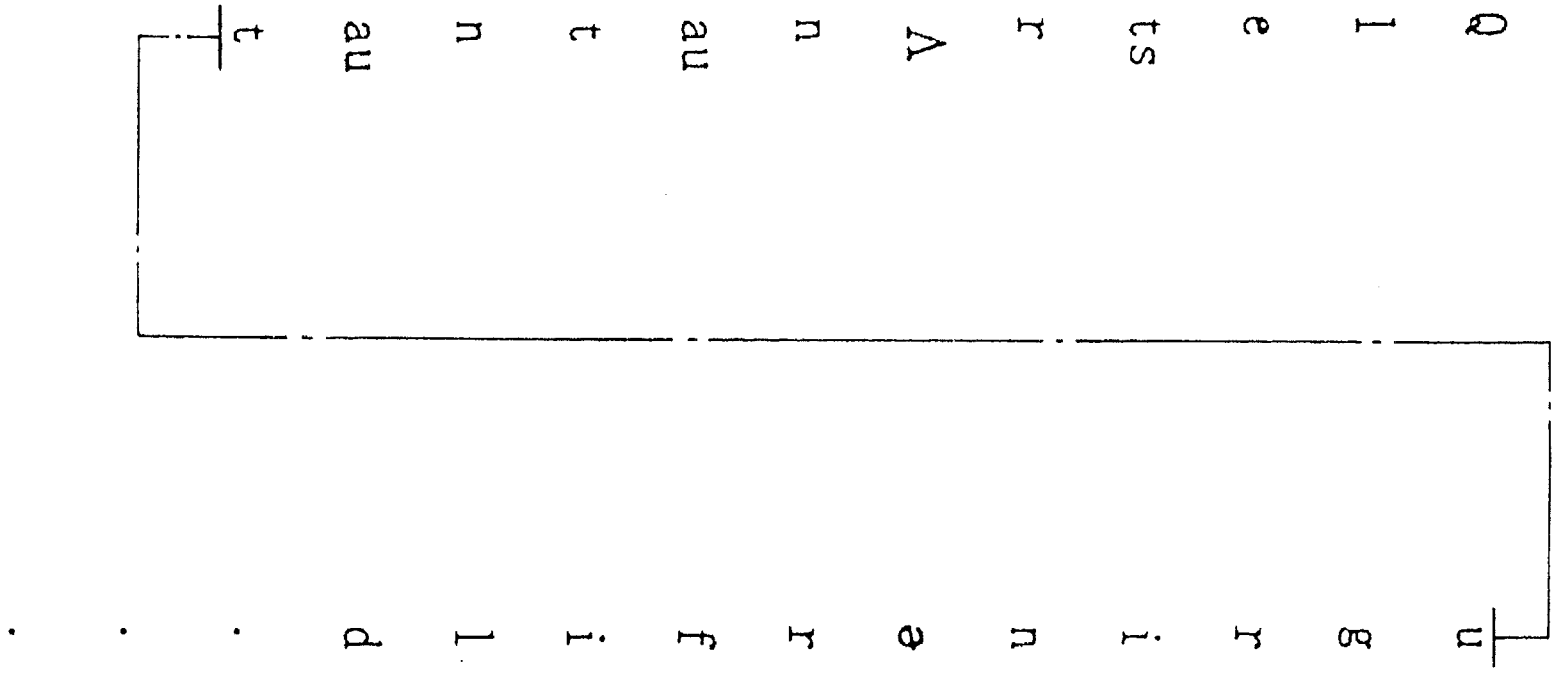
FIG. 4 PRIOR ART
FIG. 4 shows phonetic symbols of the words for soprano.
Figure 6:
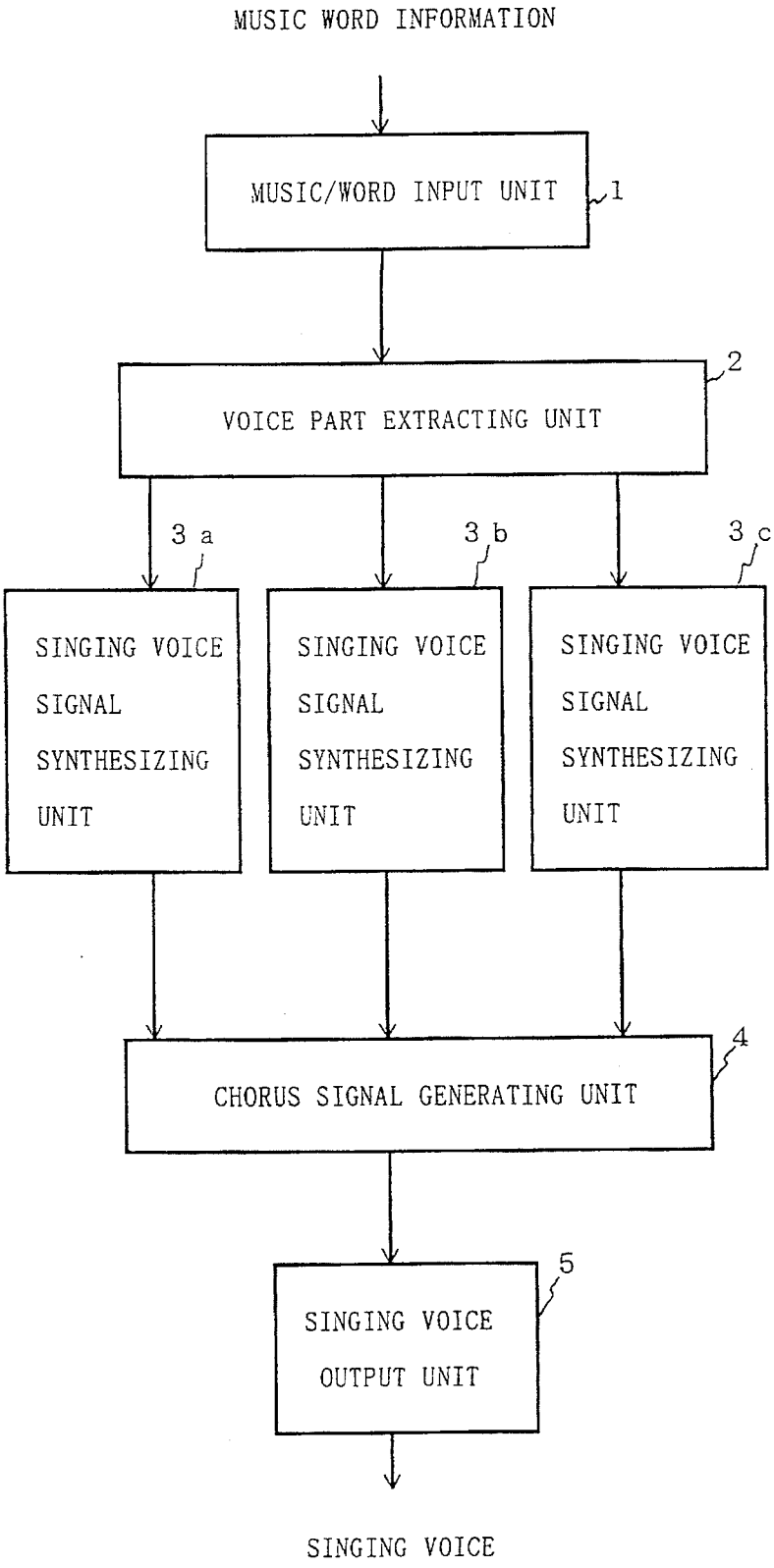
F I G. 6 PRIOR ART
FIG. 6 shows the entire configuration of the conventional singing voice signal synthesizing device.
Figure 7:
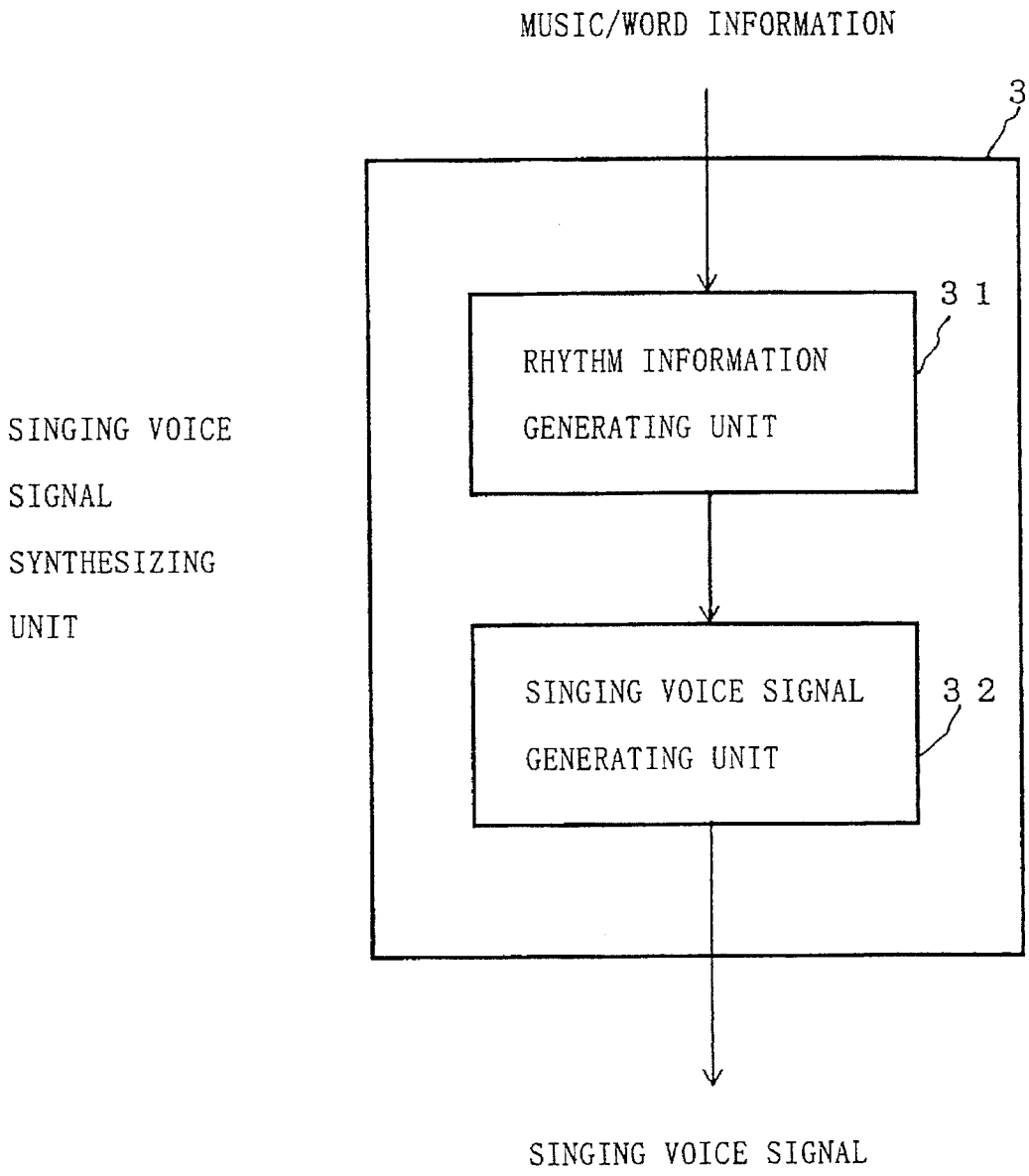
F I G. 7 PRIOR ART
FIG. 7 shows the configuration of the conventional singing voice signal synthesizing unit.
Figure 8:
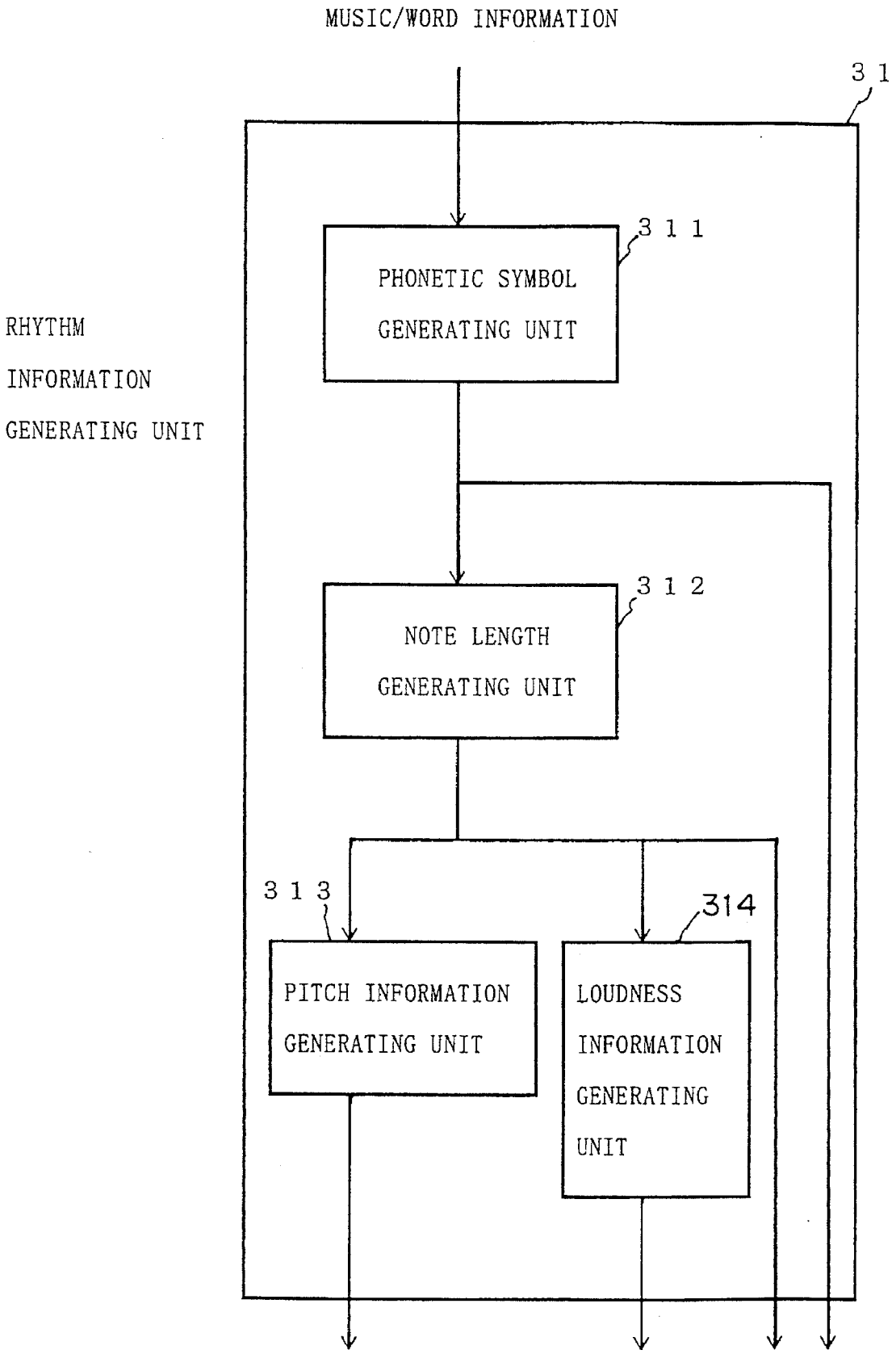
FIG. 8 PRIOR ART
FIG. 8 shows the configuration of the conventional rhythm information generating unit.
Figure 9:
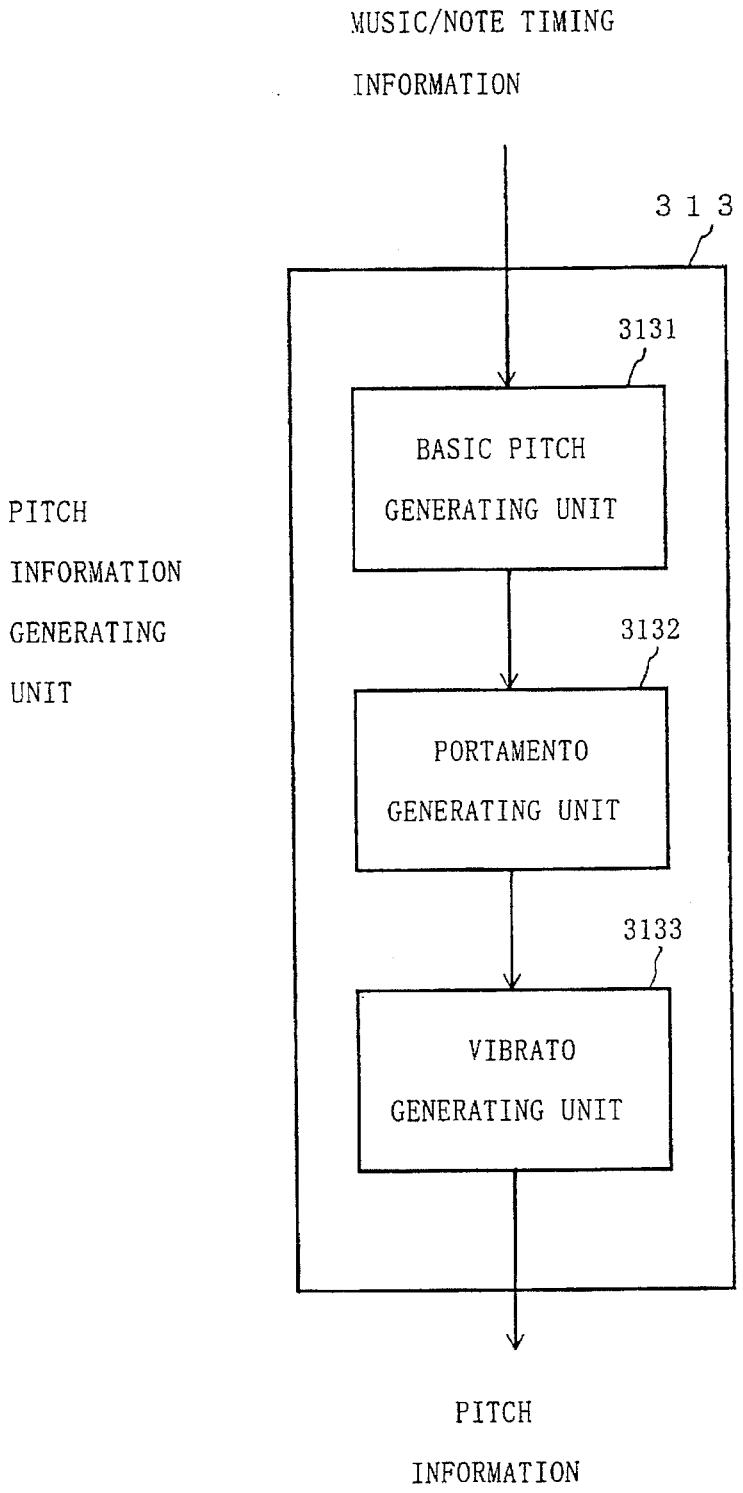
PRIOR ART FIG. 9
FIG. 9 shows the configuration of the conventional pitch information generating unit.
Figure 10:
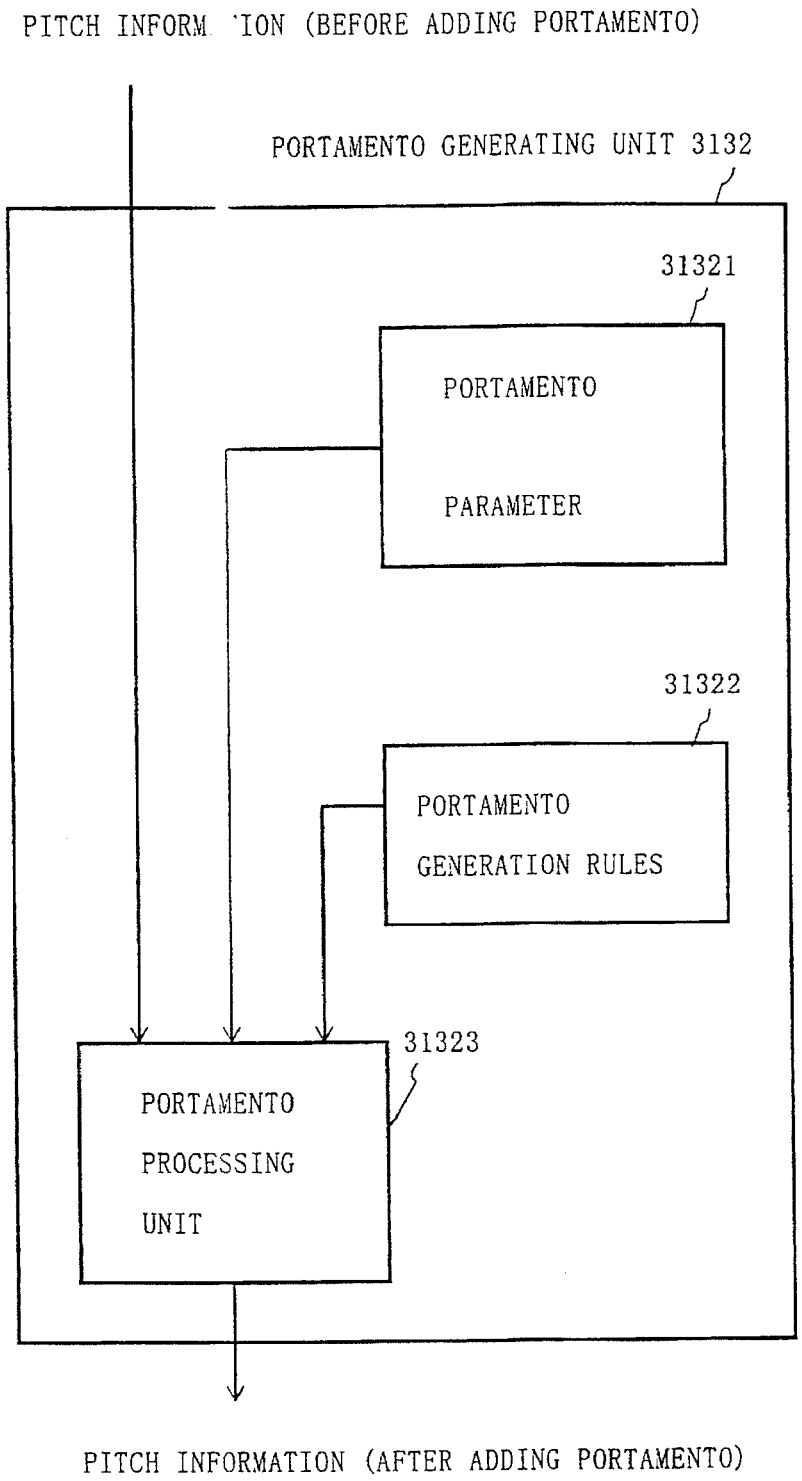
PRIOR ART FIG. 10
FIG. 10 shows the configuration of the conventional portamento generating unit.
Figure 11:
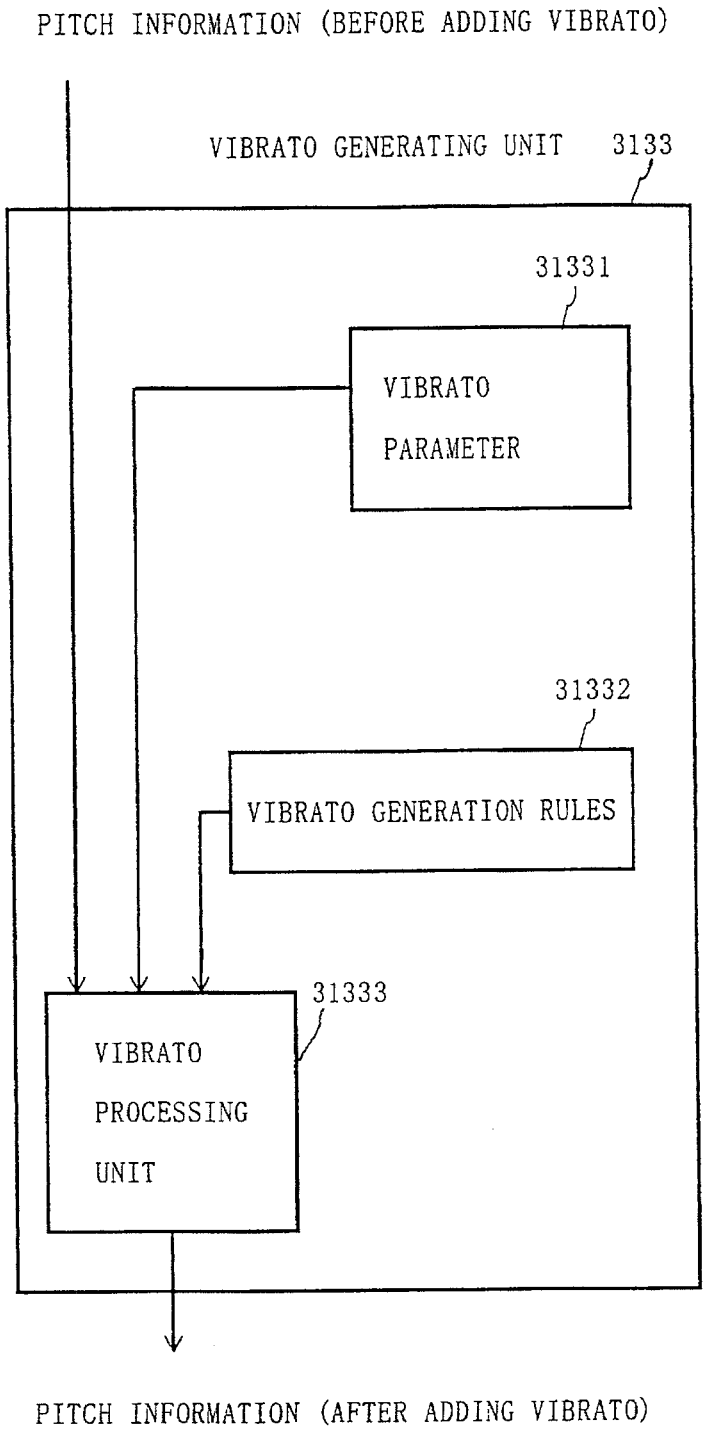
PRIOR ART FIG. 11
FIG. 11 shows the configuration of the conventional vibrato generating unit.

The outline of the embodiment of the present invention is described below by referring to FIG. 18. However, the units performing the same function as the conventional units are assigned corresponding names.

The present invention comprises a voice part extracting unit 102 for extracting for each voice part music/word information from a music/word input unit 101, a note length information changing unit 106 and a pitch information changing unit 107 for respectively changing note length information and pitch information from the music/word information extracted for each voice part by the voice part extracting unit 102 such that the note length information and pitch information can be appropriately changed for each voice part, and a loudness information changing unit 108 for changing loudness information for use in changing the loudness of a specified voice part.

Singing voice signal synthesizing units 103*a* through 103*c* synthesize singing voice signals for respective voice parts based on the music/word information extracted for each voice part, the note length changed by the note length information changing unit 106, the pitch information changed by the pitch information changing unit 107, and the loudness information changed by the loudness information changing unit 108.

The singing voice signal synthesizing units 103*a* through 103*c* comprise a phonetic symbol generating unit 311 for generating phonetic symbol after dividing into vowels and consonants a word of a song obtained from word information extracted for each voice part as shown in FIGS. 20 through 24. The singing voice signal synthesizing units 103*a* through 103*c* further comprise a note length generating unit 312 for generating a note length corresponding to the note information for use in generating a singing voice signal from the music information extracted for each part and for generating a phoneme length corresponding to a phonetic symbol, a note length adding unit 315 for adding to the note length the note length change amount generated by the note length information changing unit 106, a pitch information generating unit 313 for generating a pitch of a singing voice signal for each voice part based on the pitch information from the pitch information changing unit 107, a loudness information generating unit 314 for generating the loudness for each voice part based on the loudness information from the loudness information changing unit 108, and a singing voice signal generating unit 32 for generating a singing voice signal according to a phonetic symbol generated by the phonetic symbol generating unit 311, a note length generated by the note length adding unit 315, pitch information generated by the pitch information generating unit 313, and the loudness information generated by the loudness information generating unit 314.

The pitch information changing unit 107 comprises a portamento parameter change amount generating unit 71 for generating a portamento parameter change amount for use in changing, for each voice part, portamento which is used to give a smooth change in a fundamental frequency of a singing voice signal, a vibrato parameter change amount generating unit 72 for generating a vibrato parameter change amount for use in changing, for each voice part, vibrato to be added to a singing voice signal, or a pitch fluctuation generating unit 73 for providing a singing voice signal with an irregular fluctuation in a fundamental frequency.

Otherwise, the pitch information changing unit 107 can comprise the portamento parameter change amount generating unit 71, the vibrato parameter change amount generating unit 72, and the pitch fluctuation generating unit 73.

The music and word information received from the musical score/word input unit 101 is divided for respective voice parts by the voice part extracting unit 102. The note length information of music information is changed by the note length information changing unit 106 and the pitch information is changed by the pitch information changing unit 107 such that respective voice parts are assigned different information.

Furthermore, the loudness information changing unit 108 changes loudness information to increase the loudness when a performance is given by only a single voice part in a chorus.

Figure 20:
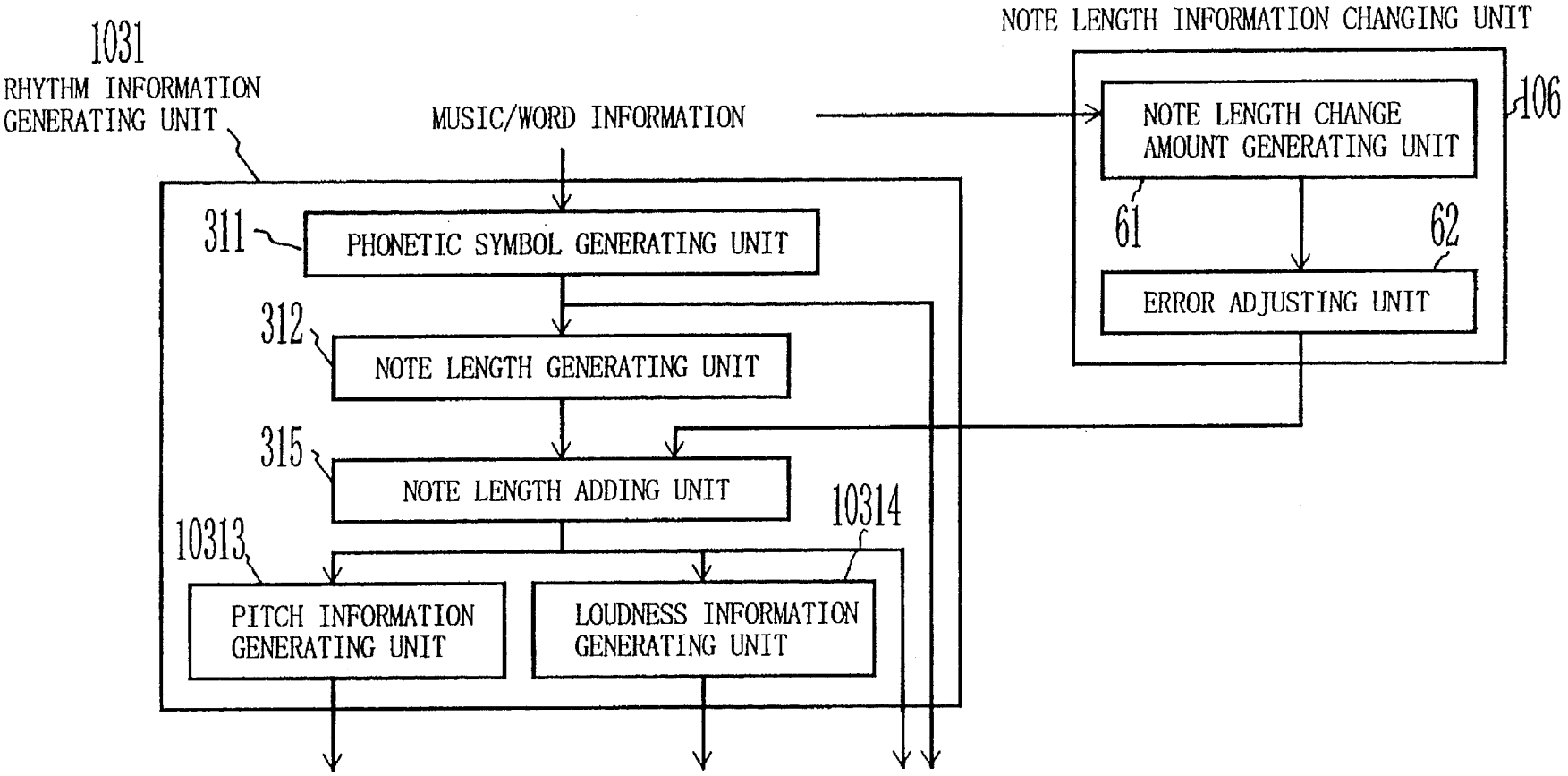
FIG. 20 shows the configuration of the rhythm information generating unit and the note length information changing unit.

Next, the singing voice signal synthesizing unit 103 receives word information divided into respective voice parts by the voice part extracting unit 102, and according to the word information the phonetic symbol generating unit 311 divides a word into vowels and consonants to generate respective phonetic symbols as shown in FIG. 20. The note length is generated corresponding to each phonetic symbol by the note length generating unit 312.

Then, the note length adding unit 315 adds to the generated note length a note length change amount generated for each voice part by the note length information changing unit 106.

Based on the pitch information changed by the pitch information changing unit 107, the pitch information of a singing voice signal for each voice part is generated by the pitch information generating unit 313. According to the loudness information changed by the loudness information changing unit 108, the loudness information generating unit 314 generates the loudness information for a performance by a single voice part.

Thus, a singing voice signal is generated by the singing voice signal generating unit 32 based on a phonetic symbol generated by the phonetic symbol generating unit 311, a phoneme length generated by the note length adding unit 315, a pitch information generated by the pitch information generating unit 313, and the loudness information generated by the loudness information generating unit 314.

The note length generated for each voice part and a singing voice signal providing pitch information are transmitted to the chorus signal generating unit 104 and added up to generate a chorus signal. Then, the chorus signal is output as a singing voice by the singing voice output unit 105 such as an amplifier, speaker, etc.

The embodiment of the present invention is described in detail by referring to the attached drawings.

Figure 18:
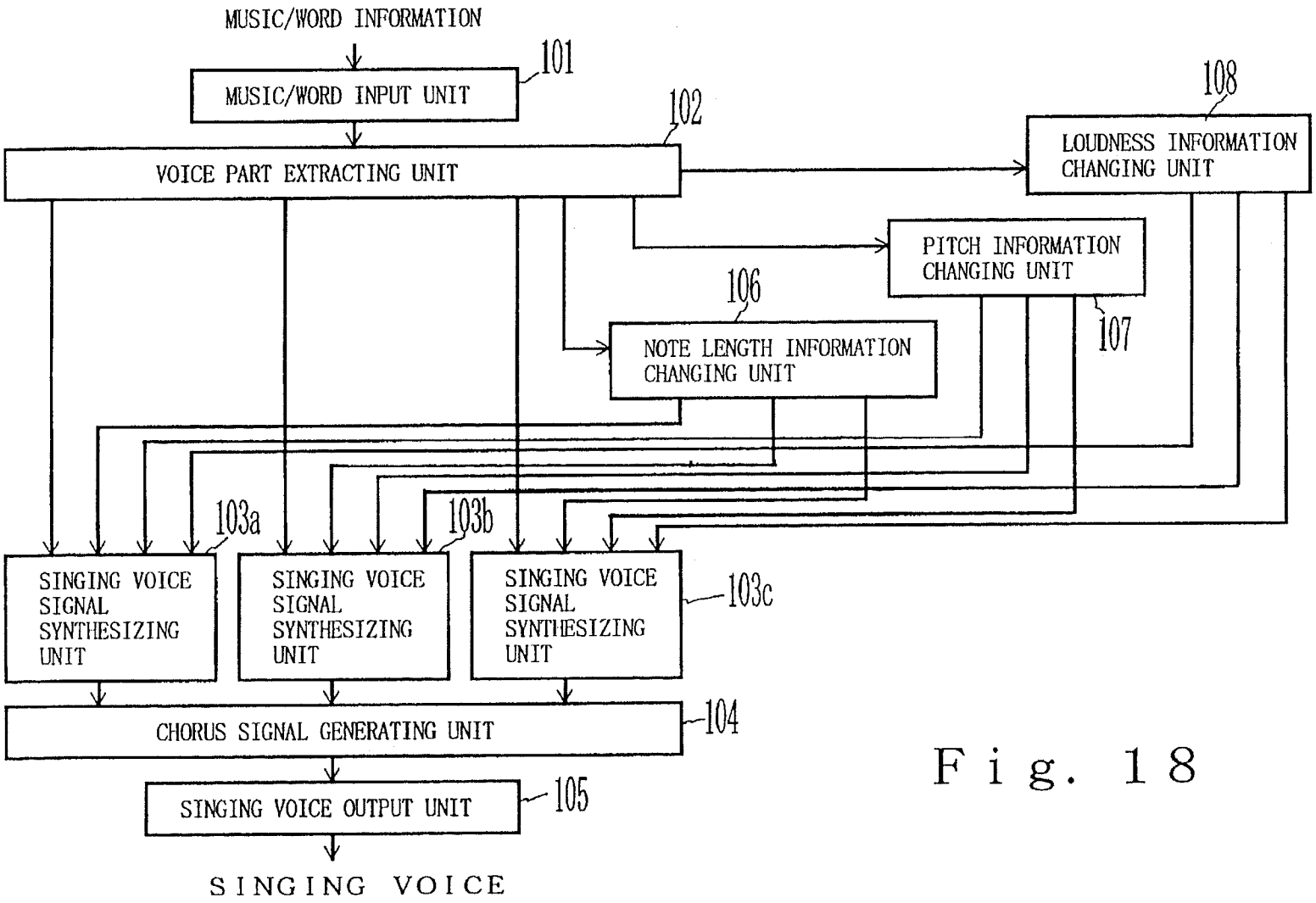
FIG. 18 shows the entire configuration of the embodiment of the present invention.

FIG. 18 shows the general configuration of the embodiment of the present invention. The explanation below is based on the musical score, music information, word information, music/word information after the extraction of each voice part, phonetic symbols of words of a song, and length information for vowels and consonants of words of a song shown in FIGS. 1 through 5 of the prior art technologies.

In FIG. 18, the music/word input unit 101 first receives the music and word information shown in FIG. 2. The music information is entered in the language called "MML" which is used in a musical performance through a personal computer. The music information can be entered according to a musical score by an operator, or the music information for a performance through a personal computer can be used as is. The word information is obtained corresponding to the music information and entered by an operator, etc..

The voice part extracting unit 102 extracts music and word information separately for each voice part (FIG. 3 shows the information for soprano. Similar information can be extracted for also, tenor, and bass). The music and word information for each voice part is input to different singing voice signal synthesizing units 103*a*, 103*b*, and 103*c* to synthesize a singing voice signal.

Figure 19:
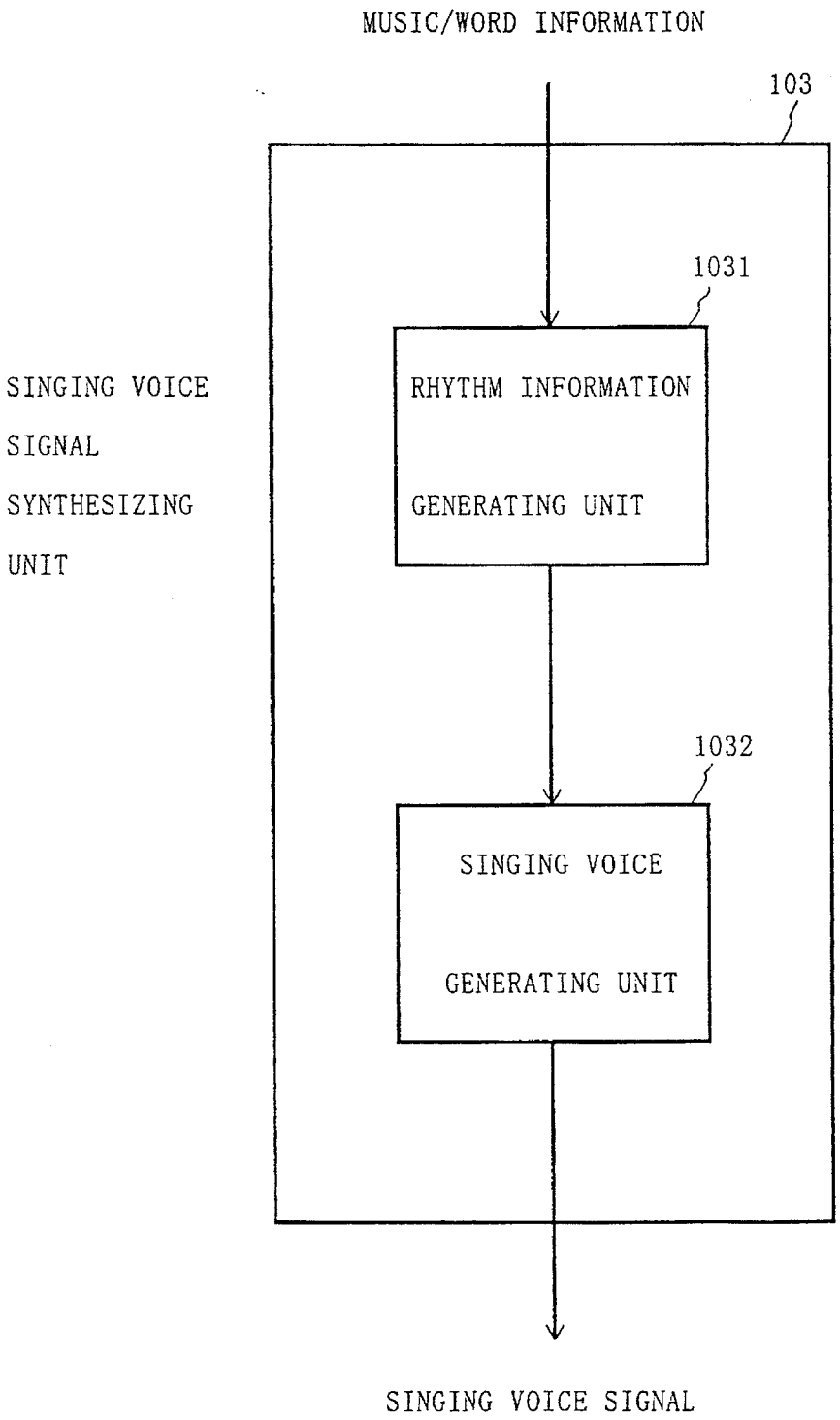
FIG. 19 shows the configuration of the singing voice signal synthesizing unit.

FIG. 19 shows the configuration of singing voice signal synthesizing units 103*a* through 103*c*. Each of the singing voice signal synthesizing units 103*a* through 103*c* comprises a rhythm information generating unit 1031 and a singing voice signal generating unit 1032.

FIG. 20 shows the configuration of the rhythm information changing unit 1031 and the note length information generating unit 106. The rhythm information generating unit 1031 comprises the phonetic symbol generating unit 311, the note length generating unit 312, a pitch information generating unit 10313, a loudness information generating unit 10314, and a note timing adding unit 315.

The phonetic symbol generating unit 311 obtains each of the phonemes, that is, vowels and consonants, forming phonetic symbols generated from words of a song in word information for each voice part and generates a plurality of phonetic symbols as shown in FIG. 3.

Figure 13:
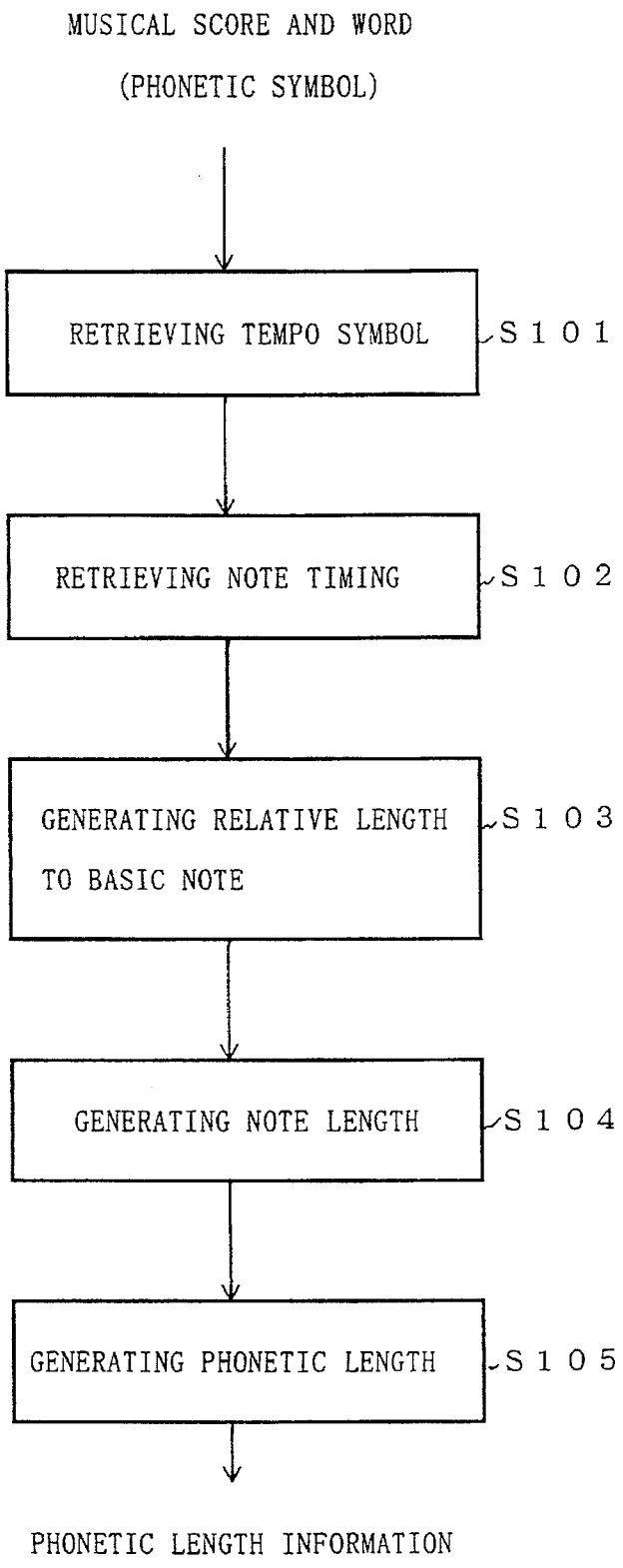
FIG. 13 PRIOR ART
FIG. 13 is a flowchart showing the conventional operation of generating a note length information and phoneme length information.

The note length generating unit 312 generates length information of each phoneme from music information and phonetic symbols as shown in FIG. 5. The generating method is the same as the prior art (refer to the operational flowchart shown in FIG. 13).

The note length information changing unit 106 changes the performance time of each note having a constant fundamental frequency for each voice part such that the note lengths are different among four voice parts. The note length information changing unit 106 comprises a note length change amount generating unit 61 and an error adjusting unit 62.

Figure 28:
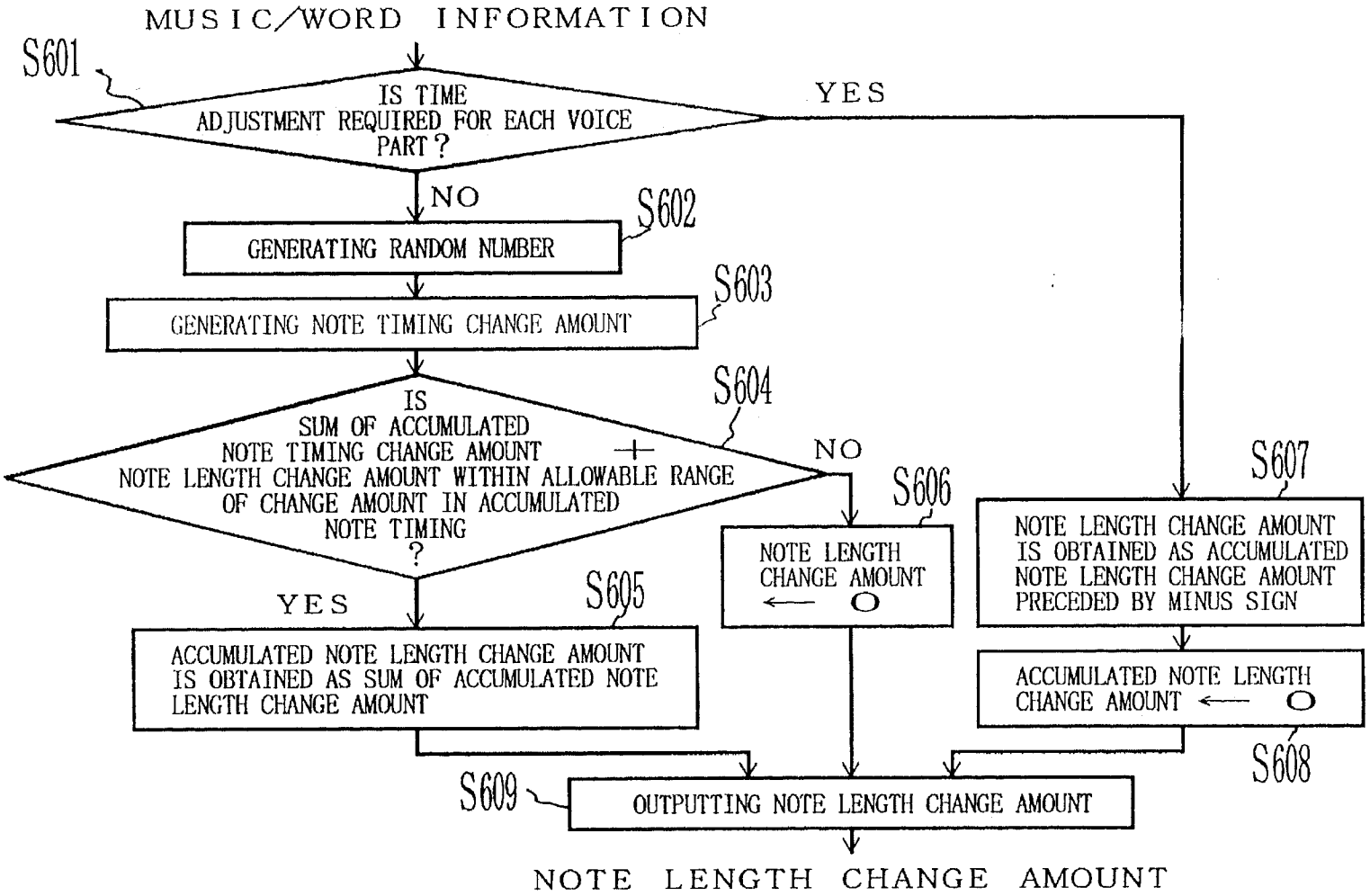
FIG. 28 is a flowchart showing the operation of changing the length of a note.

Next, the operations of the note length change amount generating unit 61 and the error adjusting unit 62 are explained by referring to the operational flowchart shown in FIG. 28.

1) First, it is determined whether or not the timing adjustment is required among four voice parts. The timing adjustment among the four voice parts is required, for example, to prevent the performances of respective voice parts from indicating time lags in generating a musical sound of each voice because the time lags make the performance sound unnatural at the start of a performance immediately after a rest (step S 601).

2) If the time adjustment is required among four voice parts, the error adjusting unit 62 assigns to a note length change amount an accumulated note length change amount preceded by a reverse sign (a positive value is converted into a negative value, while a negative value is converted into a positive value). This indicates that all time lags among accumulated singing voice parts are entirely cleared (step S 607).

3) Then, "0" is assigned to the accumulated note length change amount. This indicates that the accumulated note length change amount is entirely cleared for the same reason as the previous step. After the process, control is passed to step S 609 (step S 608).

4) If the time adjustment among four voice parts is not required in step S 601, then a random number is generated. The timing value generated as a random number is relatively smaller than the note length generated by the word information, and can be a positive or a negative (step S 602).

5) The note length change amount is generated. Accordingly, the random number generated in the previous step is assigned to the note length change amount (step S 603).

6) It is determined whether or not a sum of (accumulated note length change amount + note length change amount) is within an allowable range. For example, if the positive or negative value of the previous note length change amount is relatively large, the accumulated note length change amount is gradually incremented and indicates an undesirable time lag when a singing voice is regenerated and results in an unnatural performance. If the value is within an allowable range, control is passed to step S 605. If the value is not within an allowable range, control is passed to step S 606 (step S 604).

7) If the value is within an allowable range, then a sum of (accumulated note length change amount + note length change amount) is assigned to the accumulated note length change amount. The accumulated note length change amount indicates an accumulated time lag among four voice parts. After the process, control is passed to step S 609 (step S 605).

8) If the value is not within an allowable range in step S 604, then an error adjusting unit 62 assigns 0 to the note length change amount, and control is passed to step S 609 to prevent the time lag among the voice parts from getting out of the allowable range (step S 606).

9) Thus, the generated note length change amount is output to the note length adding unit 315 in the rhythm information generating unit 1031 of a corresponding voice part (step S 609).

Thus, the note length adding unit 315 in the rhythm information generating unit 1031 adds the note length change amount generated by the note length information changing unit 106 to the note length generated by the note length generating unit 312.

Figure 34:
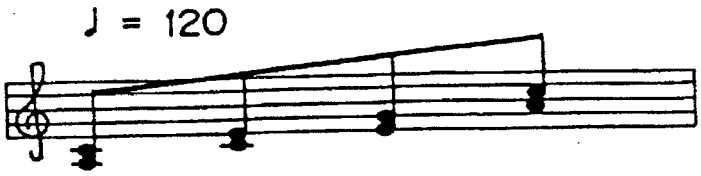
FIG. 34 shows an example of a note length depending on each voice part.

In this case, since a change in note length is made for each voice part, a time lag of note length is added for each voice part as shown in FIG. 34 (according to the conventional technologies, a constant pitch change point indicates the same note length for all voice parts).

Figure 14:
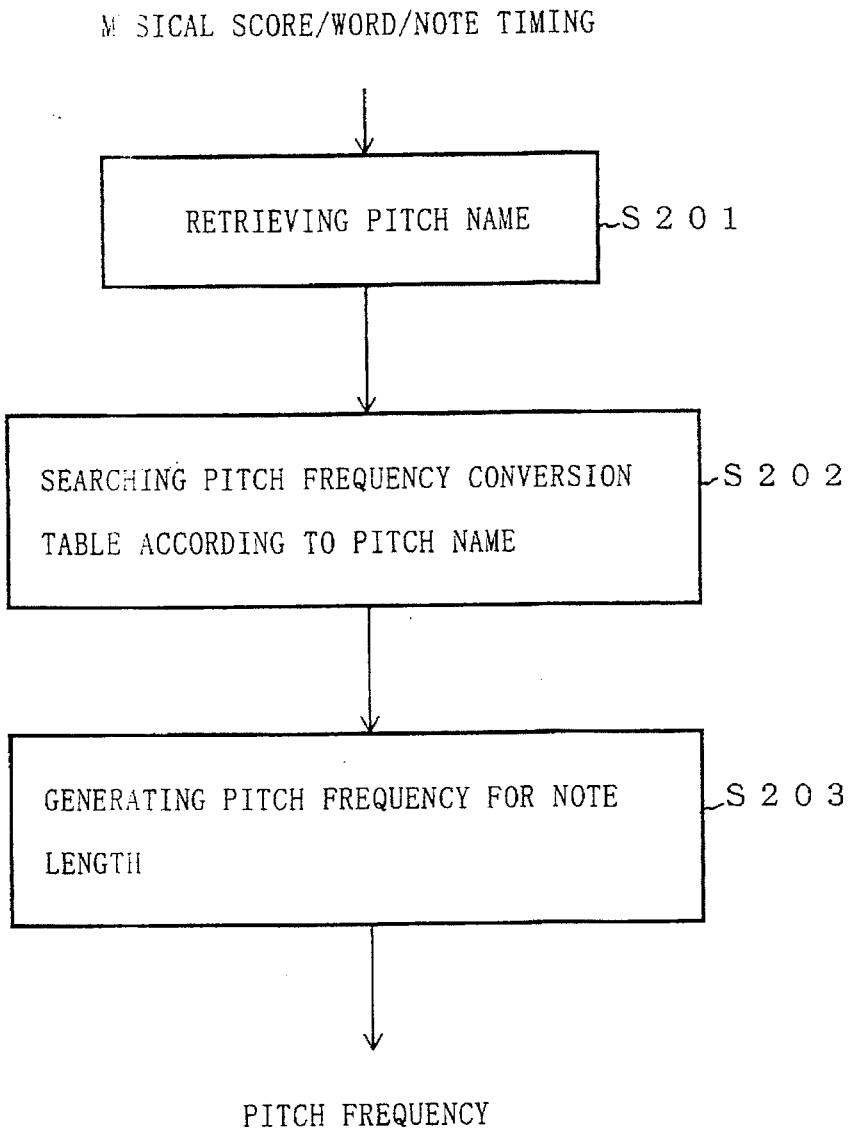
PRIOR ART FIG. 14
FIG. 14 is a flowchart showing the conventional operation of generating a fundamental frequency pattern.
Figure 15:
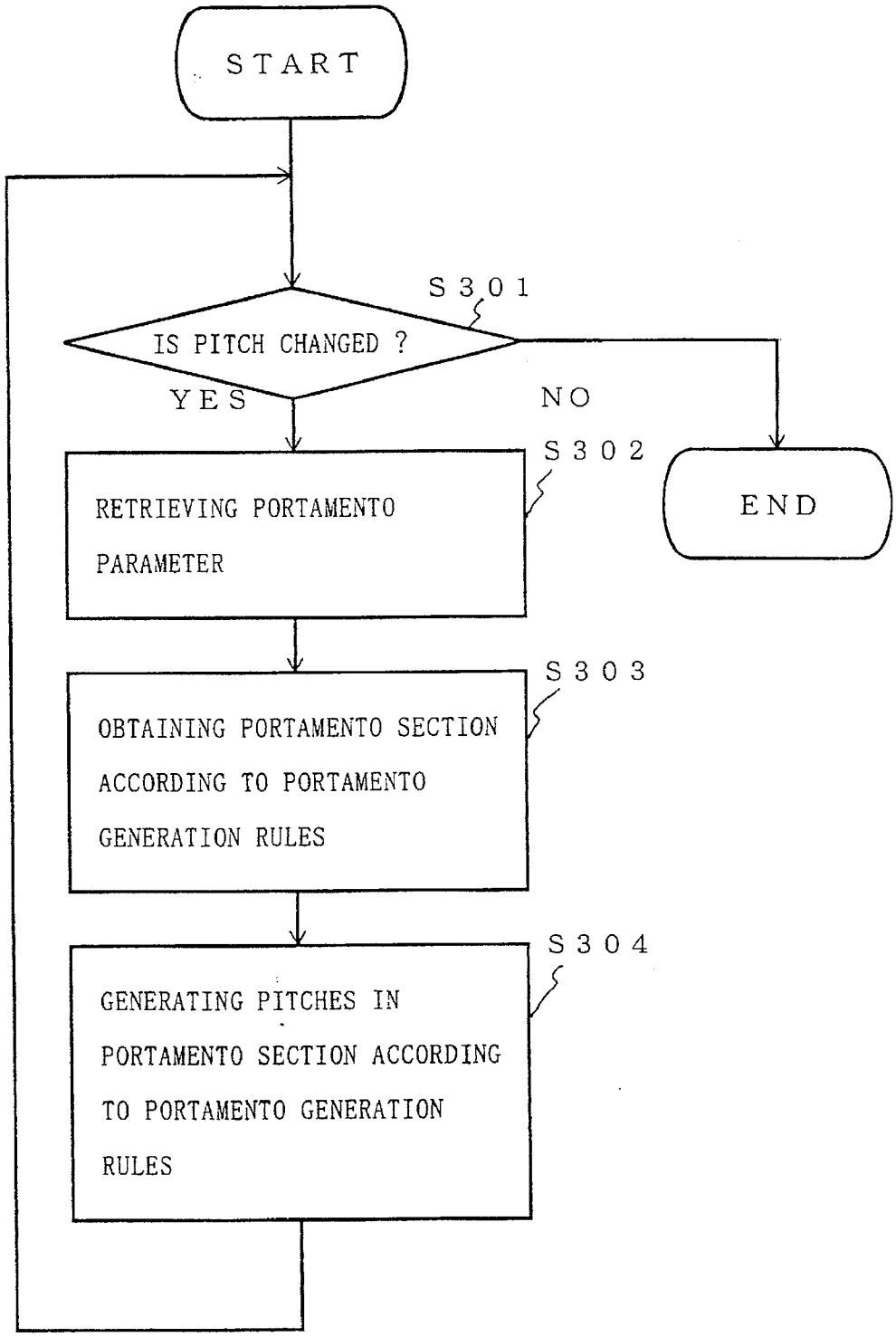
PRIOR ART FIG. 15
FIG. 15 is a flowchart showing the conventional operation of generating a portamento.
Figure 16:
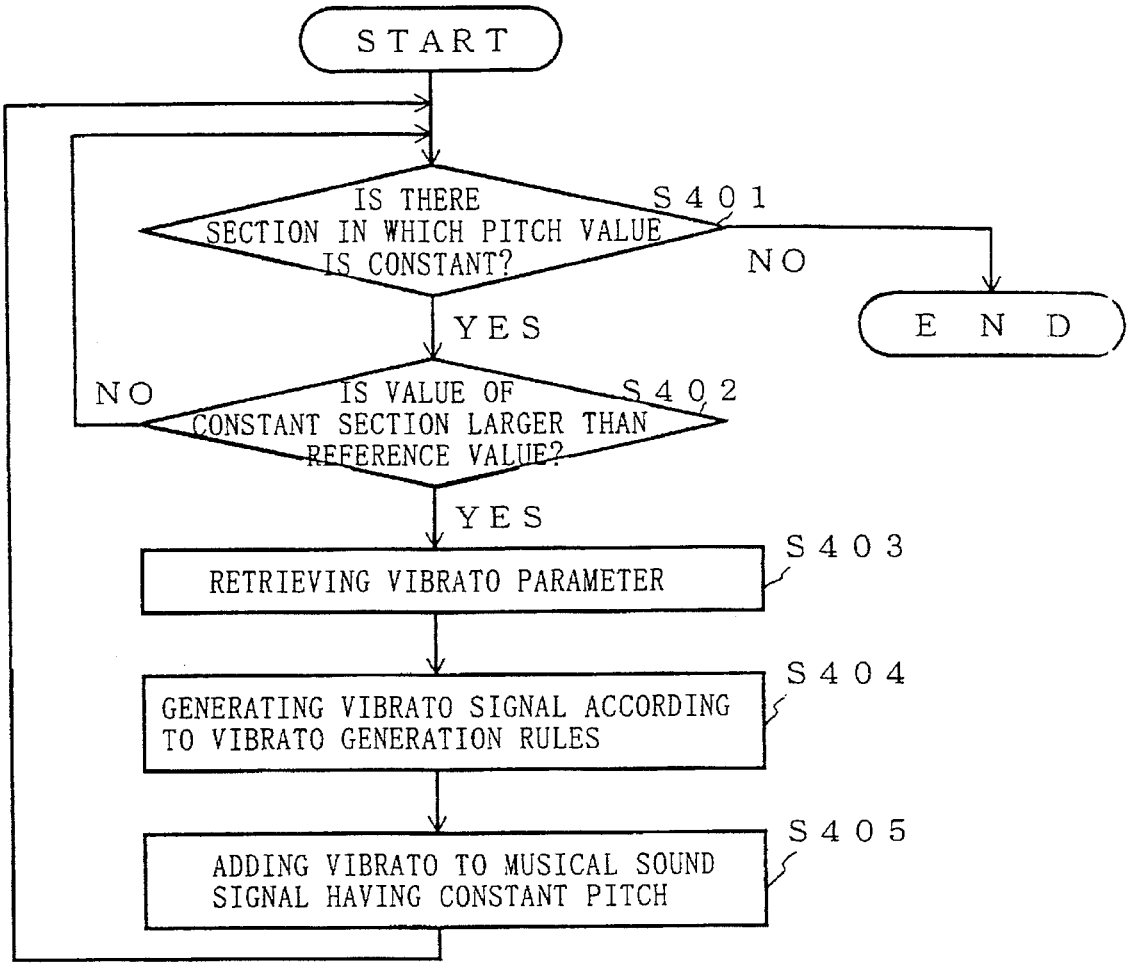
PRIOR ART FIG. 16
FIG. 16 is a flowchart showing the conventional operation of generating vibrato.
Figure 17:
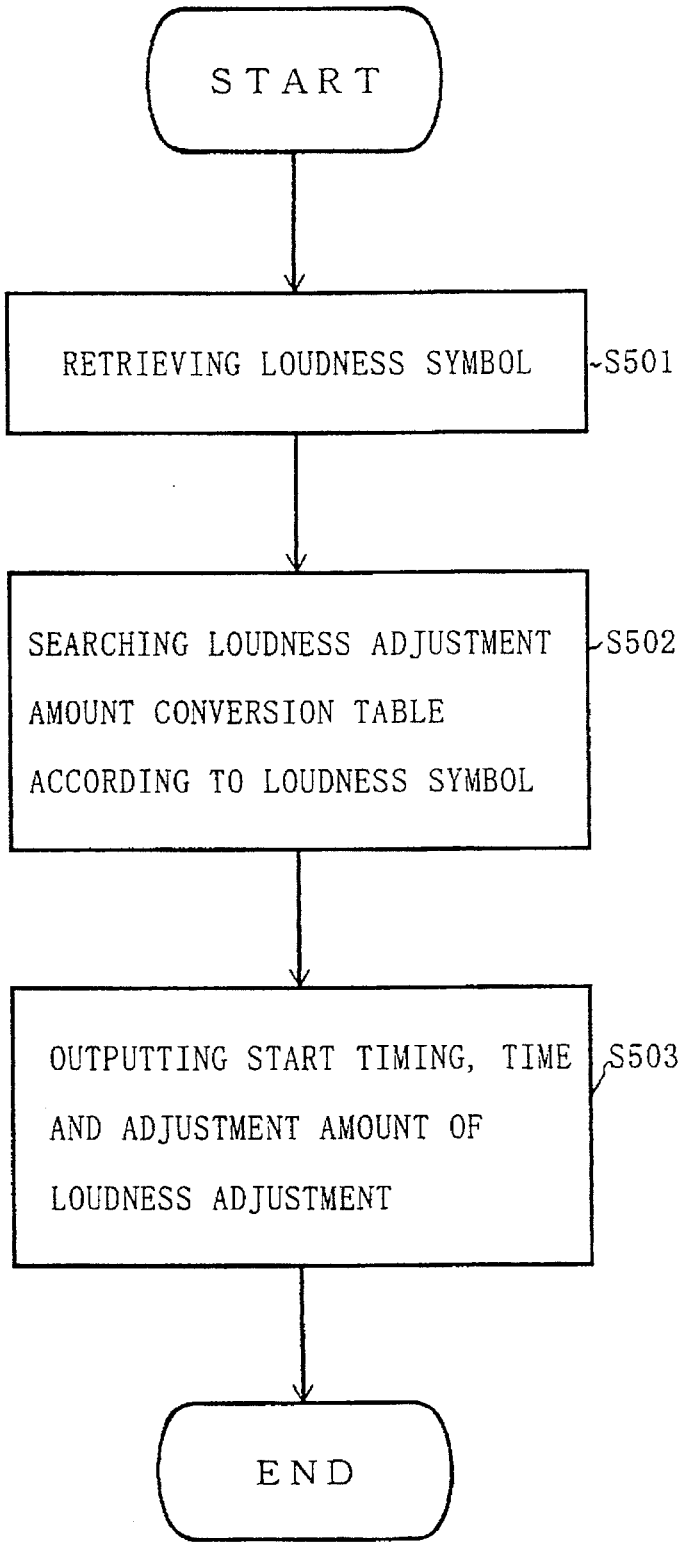
FIG. 17 is a flowchart showing the conventional operation of generating loudness information.
Figure 21:
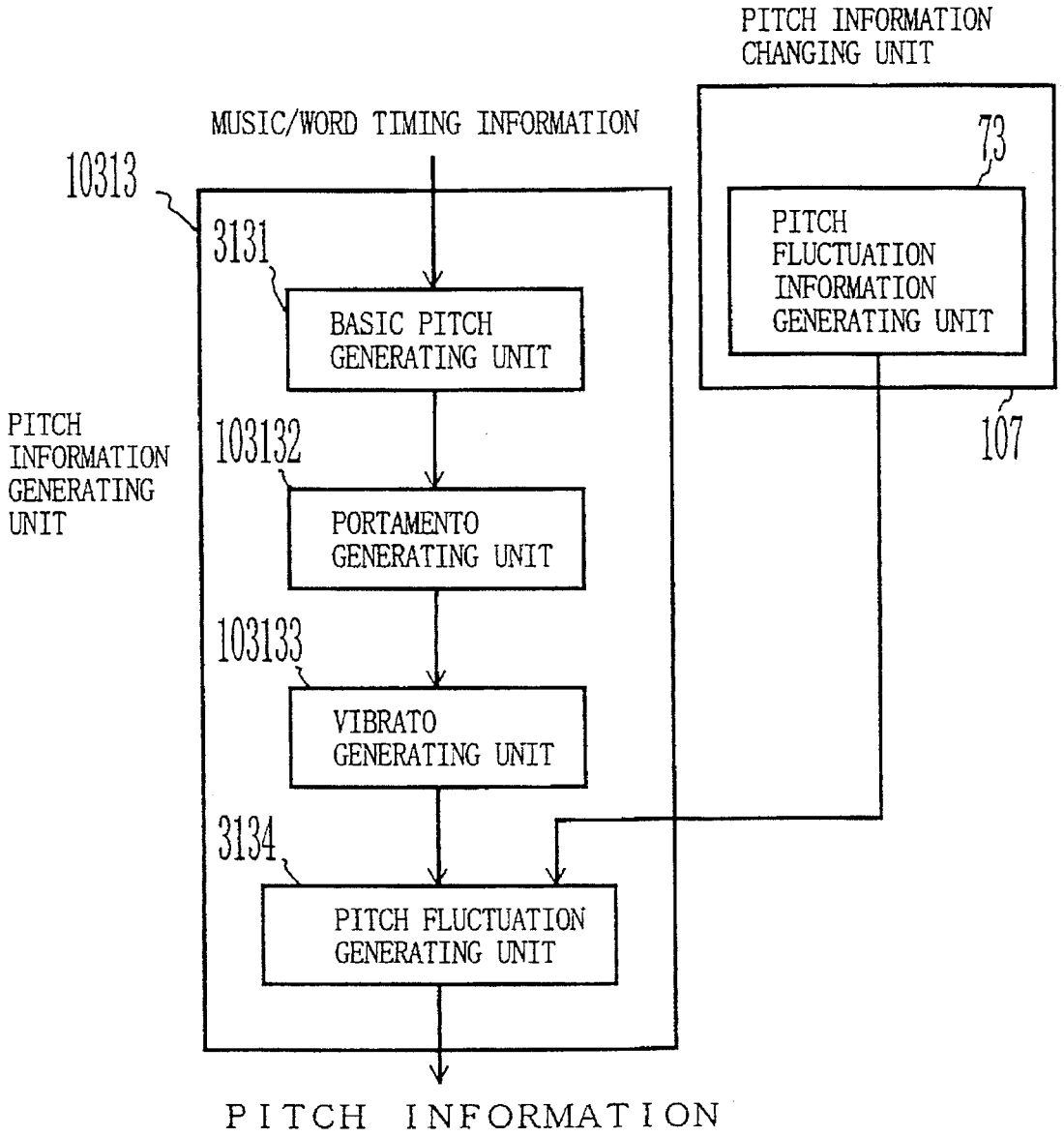
FIG. 21 shows the configuration of the fundamental frequency information generating unit and the pitch information changing unit.

Next, FIG. 21 shows in detail the configuration of a pitch information generating unit 10313 and the pitch information changing unit 107. The pitch information generating unit 10313 comprises a basic pitch generating unit 3131, a portamento generating unit 3132, a vibrato generating unit 3133, and a pitch fluctuation generating unit 3134. A method of generating a fundamental frequency pattern through the basic pitch generating unit 3131 is the same as the method according to the conventional technologies (refer to the flowchart shown in FIG. 14).

However, since a note length depends on each voice part, the size of a constant fundamental frequency also depends on each voice part. The portamento generating unit 3132 makes a discontinuous point in the fundamental frequency generated by the basic pitch generating unit 3131 indicate a smoothly continued performance as a natural chorus.

Figure 22:
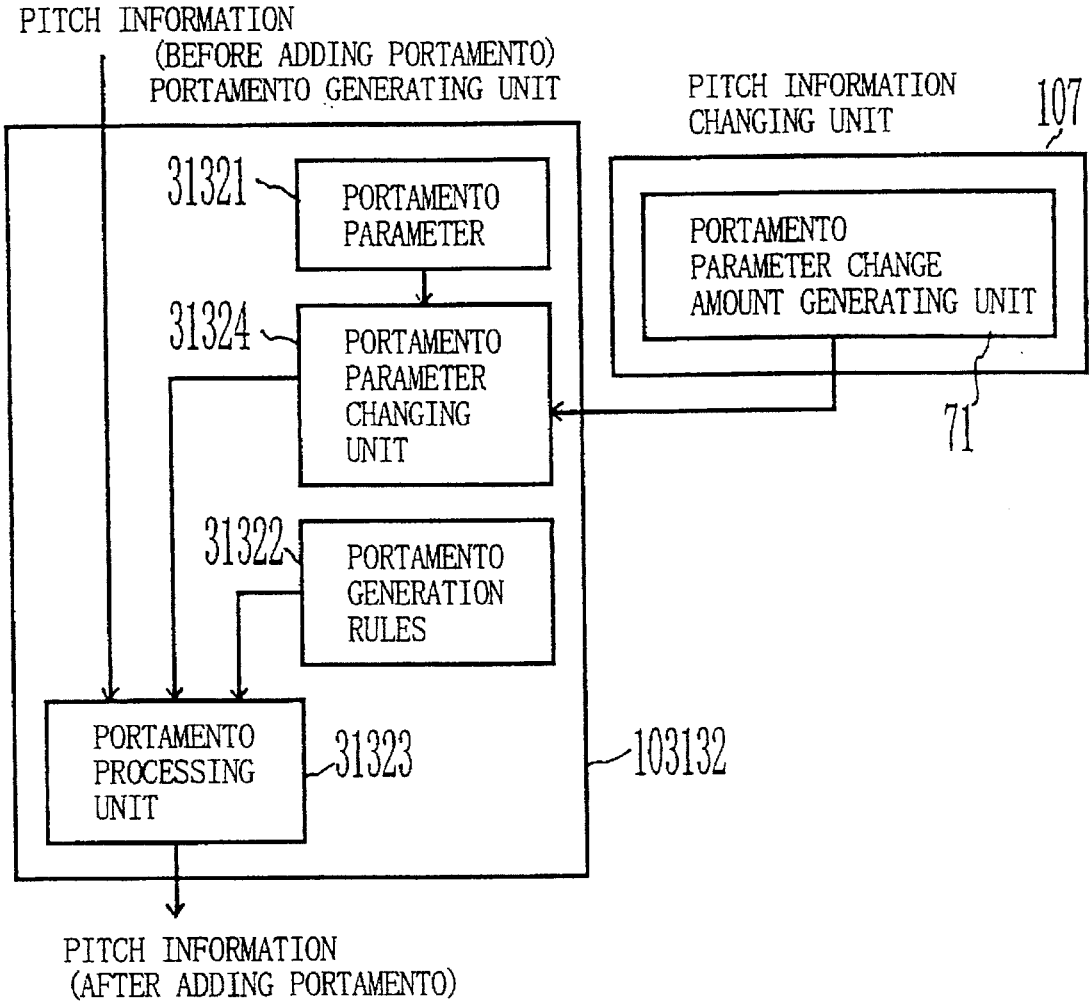
FIG. 22 shows the configuration of the portamento generating unit and the pitch information changing unit.

Next, FIG. 22 shows the detailed configuration of a portamento generating unit 103132 and the pitch information changing unit 107. The portamento generating unit 103132 comprises a portamento parameter 31321, portamento generation rules 31322, a portamento processing unit 31323, and a portamento parameter changing unit 31324.

Figure 29:
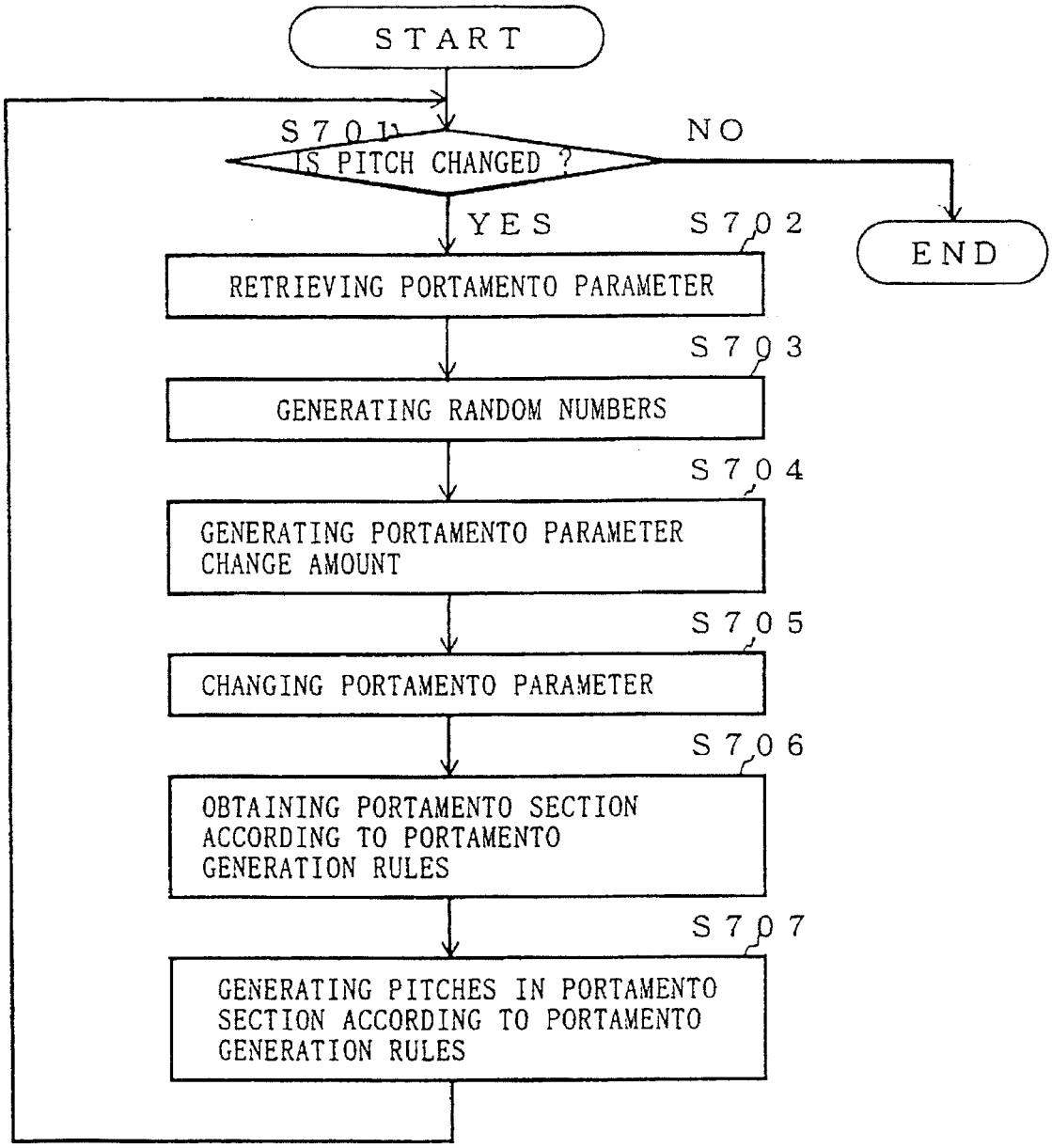
FIG. 29 is a flowchart showing the operation of generating portamento.

Next, a portamento generating operation is described by referring to an operational flowchart showing the generation of the portamento shown in FIG. 29. Since portamento is generated separately on each voice part, it is processed differently for each voice part (however, since the conventional technologies provide the same portamento generation rules and the same portamento parameter, the same portamento is generated for all voice parts).

Figure 12A:
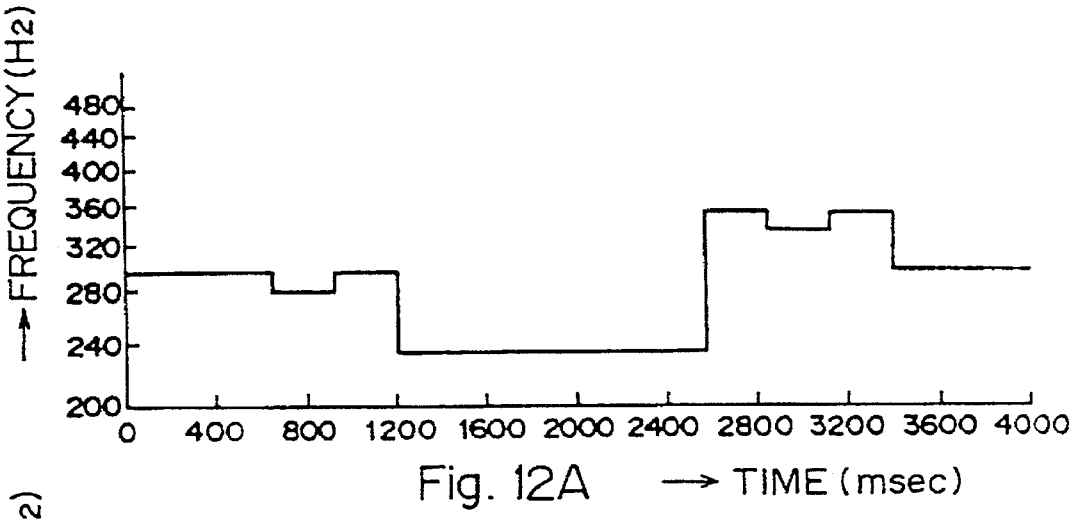
FIGS. 12A through 12C show the step of generating a fundamental frequency pattern.
Figure 12B:
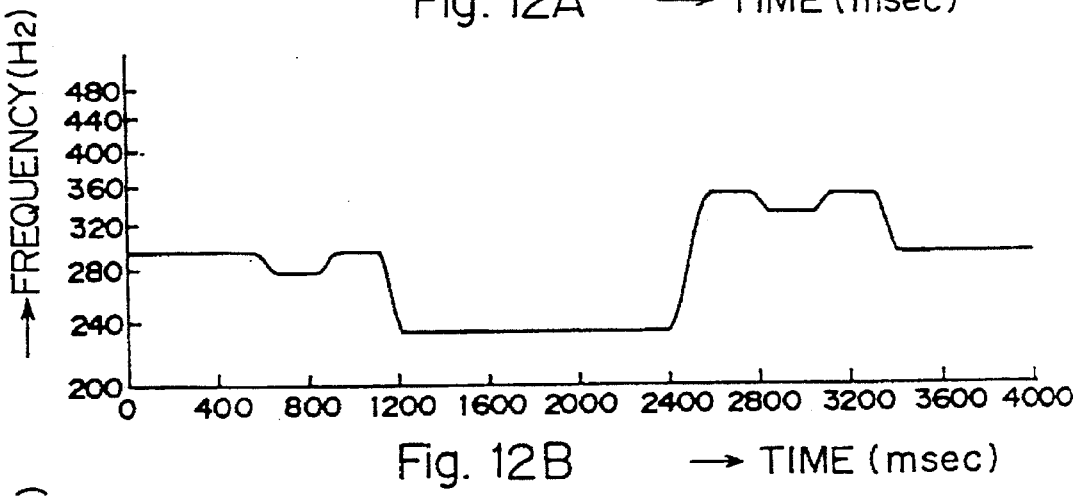
Figure 12C:
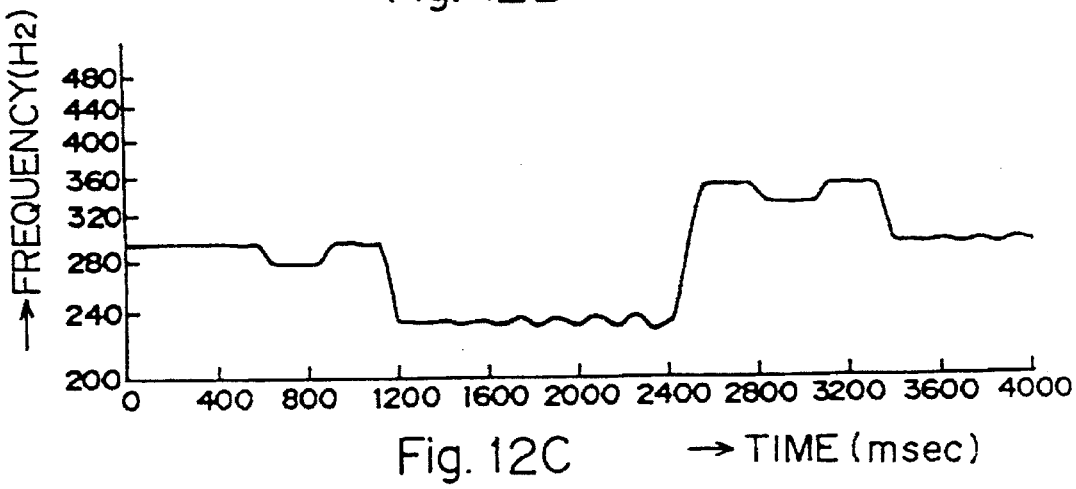
Fig. 12C PRIOR ART

1) First, it is determined whether or not there is a change in a fundamental frequency. A change in a fundamental frequency refers to a discontinuous point in a fundamental frequency pattern as shown in FIG. 12A. If there is no change in a fundamental frequency, the process terminates. If there is any change in pitch, then control is passed to the next step S 702 (step S 701).

2) The portamento parameter 31321 is retrieved. When control is passed from a fundamental frequency to another fundamental frequency, parameters of the portamento time, the obliqueness of a pitch curve of the portamento, etc. should be changed depending on the difference between the frequencies. Therefore, the associated parameters are retrieved (step S 702).

3) The portamento parameter change amount generating unit 71 (FIG. 22) in the pitch information changing unit 107 generates a random number. Random numbers should be generated corresponding to each portamento parameter for the obliqueness of portamento, the time of portamento, etc. (step S 703).

4) The random number generated in the previous step is output to the portamento parameter changing unit 31324 as a portamento parameter change amount (step S 704).

5) A new portamento parameter is obtained by adding a portamento parameter change amount to each value of portamento parameters (step S 705).

6) According to the portamento generation rules 31322, the portamento section before and after a change point of a fundamental frequency is obtained using a portamento parameter generated in the previous step (step S 706).

7) The change curve of the fundamental frequency smoothly changing in the portamento section obtained in the previous step can be obtained according to the portamento generation rules 31322, and the fundamental frequency of a sampling time unit is generated. Then, control is returned to step S 701 (step S 707).

Figure 26:
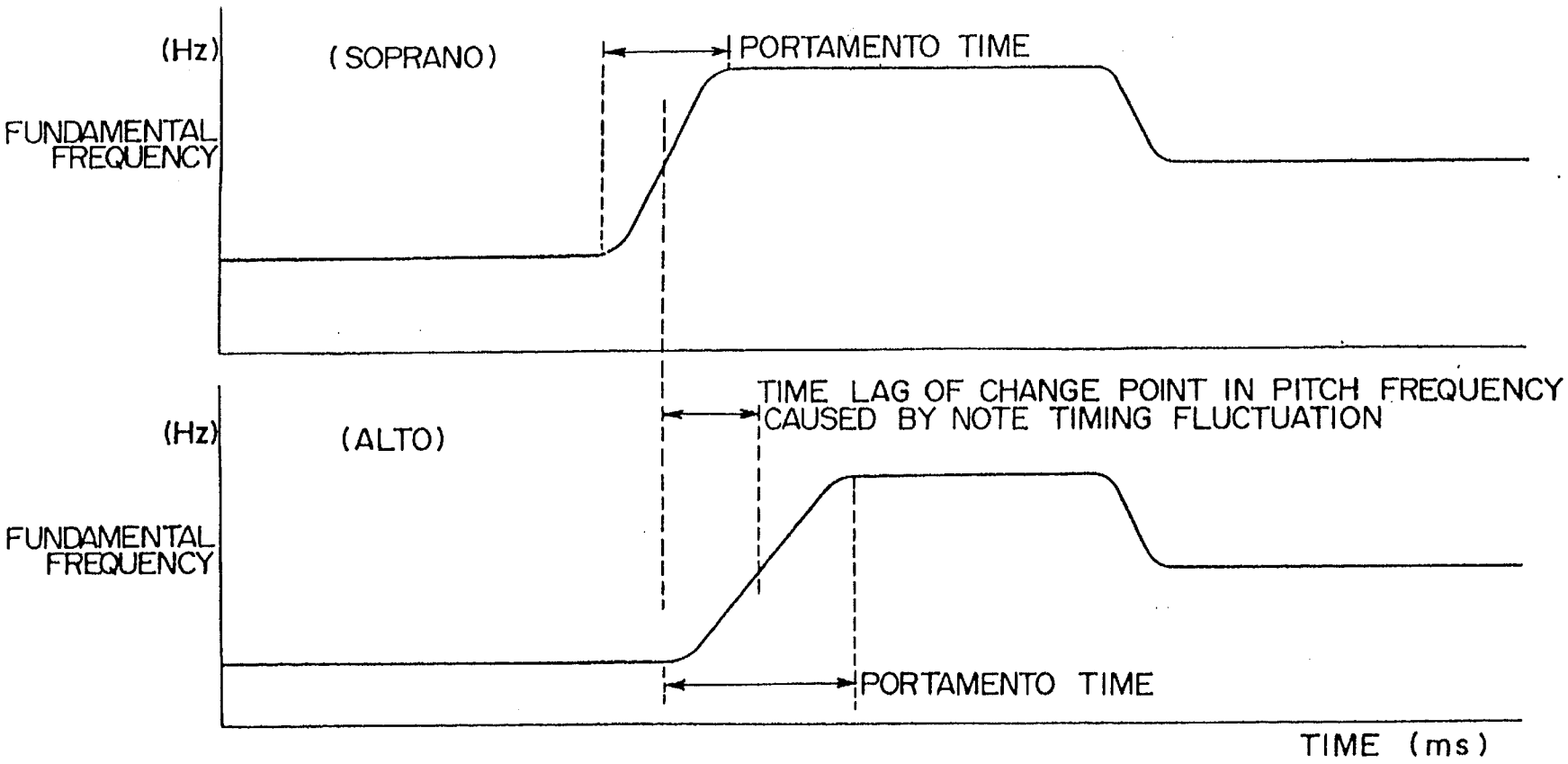
FIG. 26 shows the fundamental frequency pattern in which a portamento is provided.
Figure 27:
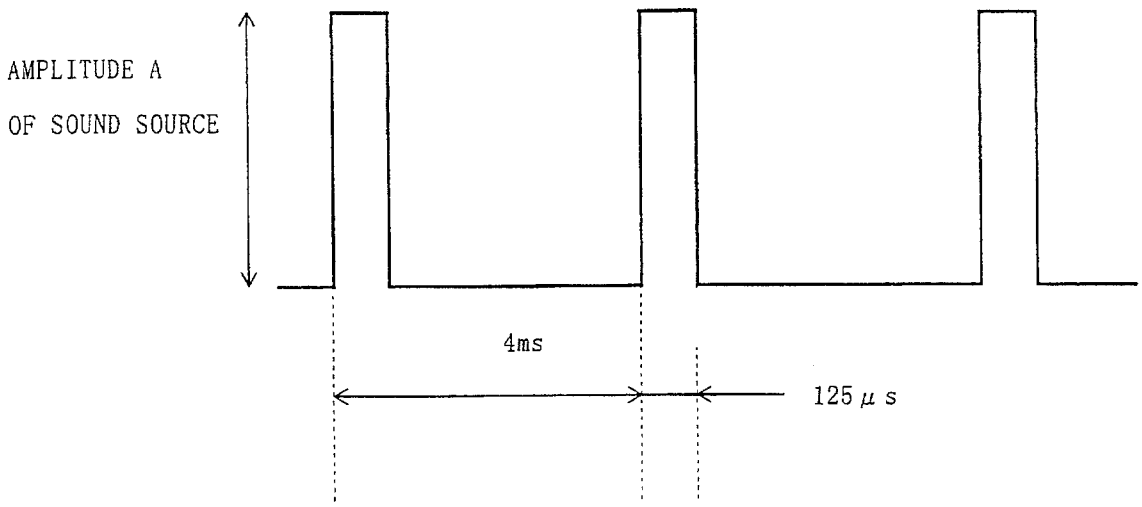
FIG. 27 shows the source of a sound generated by an impulse generating unit.

FIG. 26 shows the enlarged fundamental frequency pattern obtained after adding portamento generated by repeating the above listed processes (however, only two voice parts, that is, soprano and also in this example, are represented. Other voice parts are omitted here). The fundamental frequency pattern includes the above described note length change amount and indicates different change points of frequency, obliqueness of pitch change curves in the portamento section, and time at which portamento is provided among respective voice parts.

Figure 23:
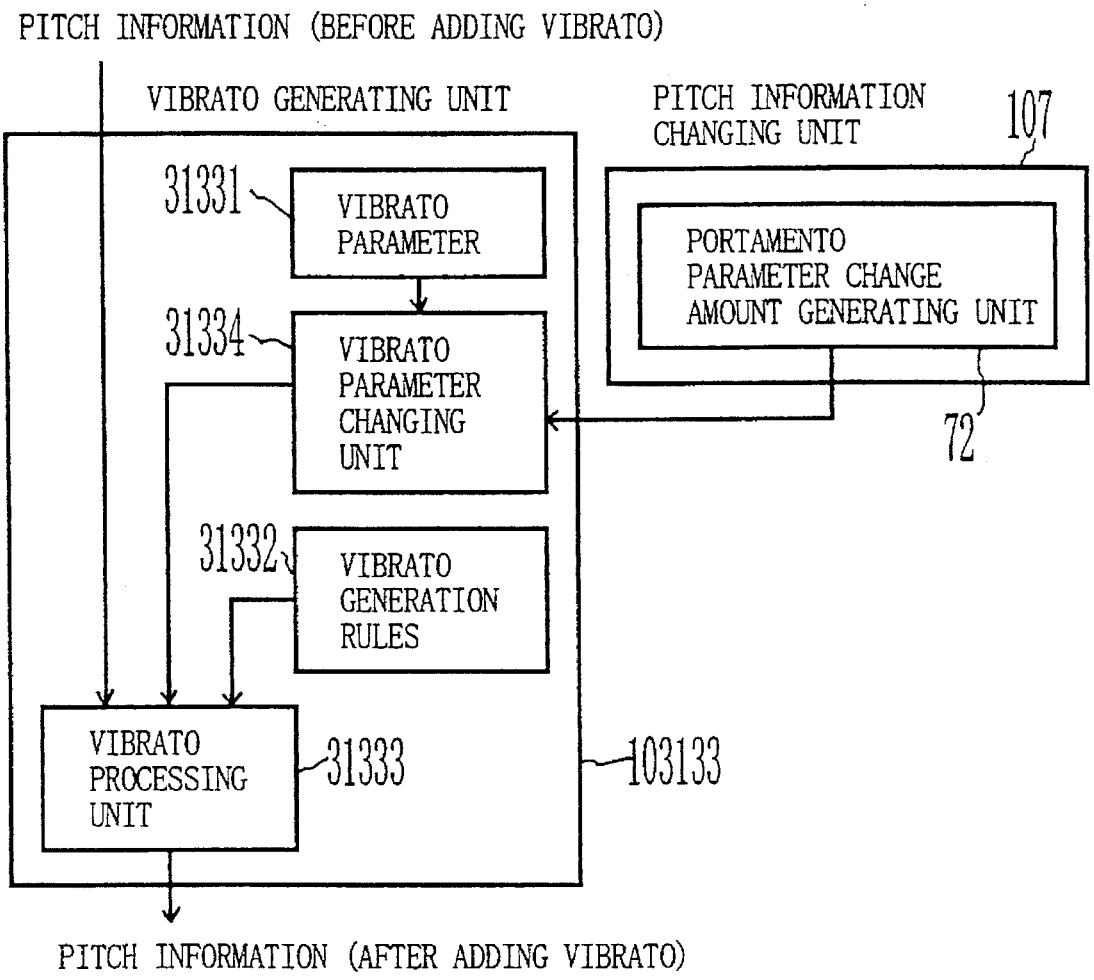
FIG. 23 shows the configuration of the vibrato generating unit and the pitch information changing unit.
Figure 24:
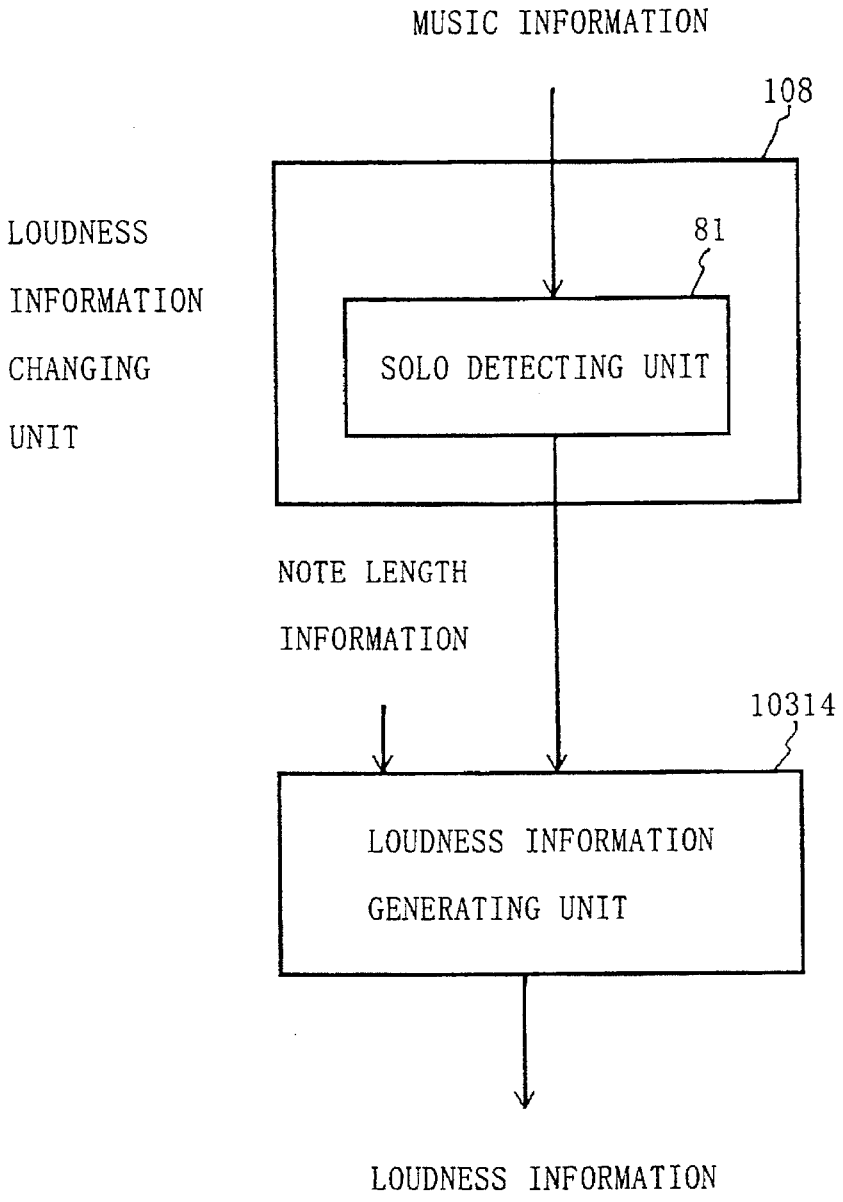
FIG. 24 shows the configuration of the loudness information changing unit and the loudness information generating unit.

FIG. 23 shows the detailed configuration of a vibrato generating unit 103133 and the pitch information changing unit 107. The vibrato generating unit 103133 comprises the vibrato parameter 31331, the vibrato generation rules 31332, the vibrato processing unit 31333, and the vibrato parameter changing unit 31334.

Figure 30:
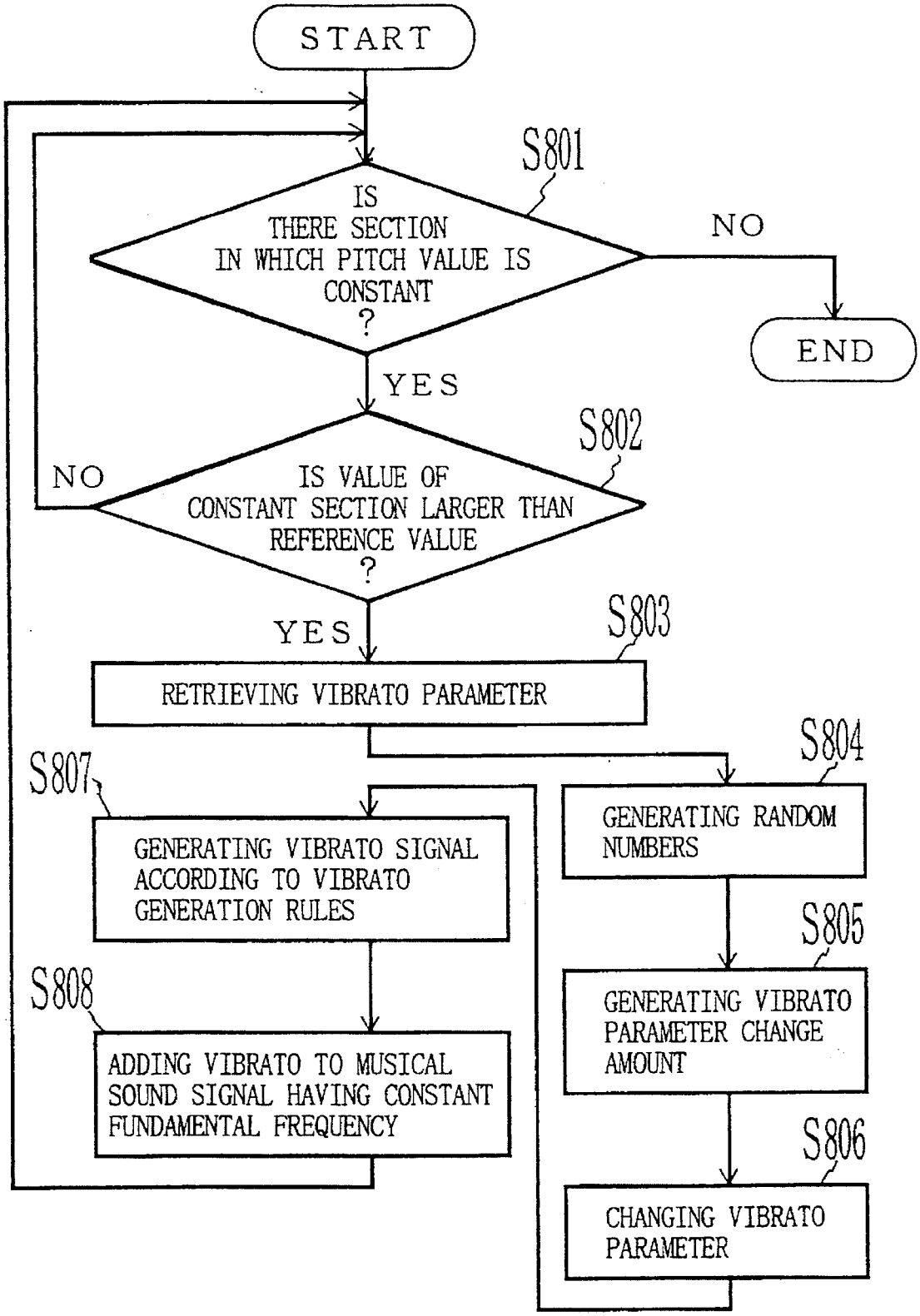
FIG. 30 is a flowchart showing the operation of generating vibrato.

The operations of the vibrato generating unit 103133 and the vibrato parameter change amount generating unit 72 in the pitch information changing unit 107 are described below by referring to the operational flowchart shown in FIG. 30. In this case, since the vibrato is generated for each voice part, the vibrato can be individually assigned to each voice part (since the conventional technologies are based on a common vibrato generation parameter and vibrato generation rules, the same vibrato is shared among respective voice parts).

1) It is determined whether or not there is a section in which a fundamental frequency indicates a constant value. If no, the process terminates. If yes, control is passed to the next step S 802 (step S 801).

2) It is determined whether or not the value of the constant section is larger than a predetermined reference value (the reference value can depend on each voice part). If yes, control is passed to the next step S 803. If no, control is returned to step S 801 because vibrato can hardly be added (step S 802).

3) A vibrato parameter 31331 is retrieved. The vibrato parameter indicating vibrato which originally is a modulated frequency periodically provides a constant fundamental frequency with normally 6 through 7 hertz of frequency modulation, and the parameter refers to a modulated frequency, the amplitude of a modulation signal, etc. (step S 803).

4) Random numbers are generated by the vibrato parameter change amount generating unit 72 in the pitch information changing unit 107. The number of random numbers is equal to the number of vibrato parameters retrieved in the previous step (step S 804).

5) The random numbers generated in the previous step are output as a vibrato parameter change amount to the vibrato parameter changing unit 31334 (step S 805).

6) A new vibrato parameter is obtained by adding the vibrato parameter change amount to the vibrato parameter (step S 806).

7) A vibrato signal is generated according to the above mentioned vibrato parameter and vibrato generation rules 31332. The vibrato generation rules are used in regulating a modulated frequency and the amplitude of a modulation signal, etc. for use in adding vibrato. For example, the rules regulates the amplitude of a modulation signal such that it becomes larger towards the end along the constant pitch portion of a fundamental frequency (step S 807).

8) Thus, vibrato is added to a constant-pitched voice part according to a vibrato signal generated in the previous step as a frequency modulation signal by frequency-modulating a singing voice signal having a constant fundamental frequency. Then, control is returned to S 801 after the adding process (step S 808).

Thus, vibrato is generated for each voice part. For example, different modulation frequencies of vibrato are assigned to respective voice parts, or vibrato of different amplitudes of frequency modulation signal is assigned to respective voice part signals.

Figure 31:
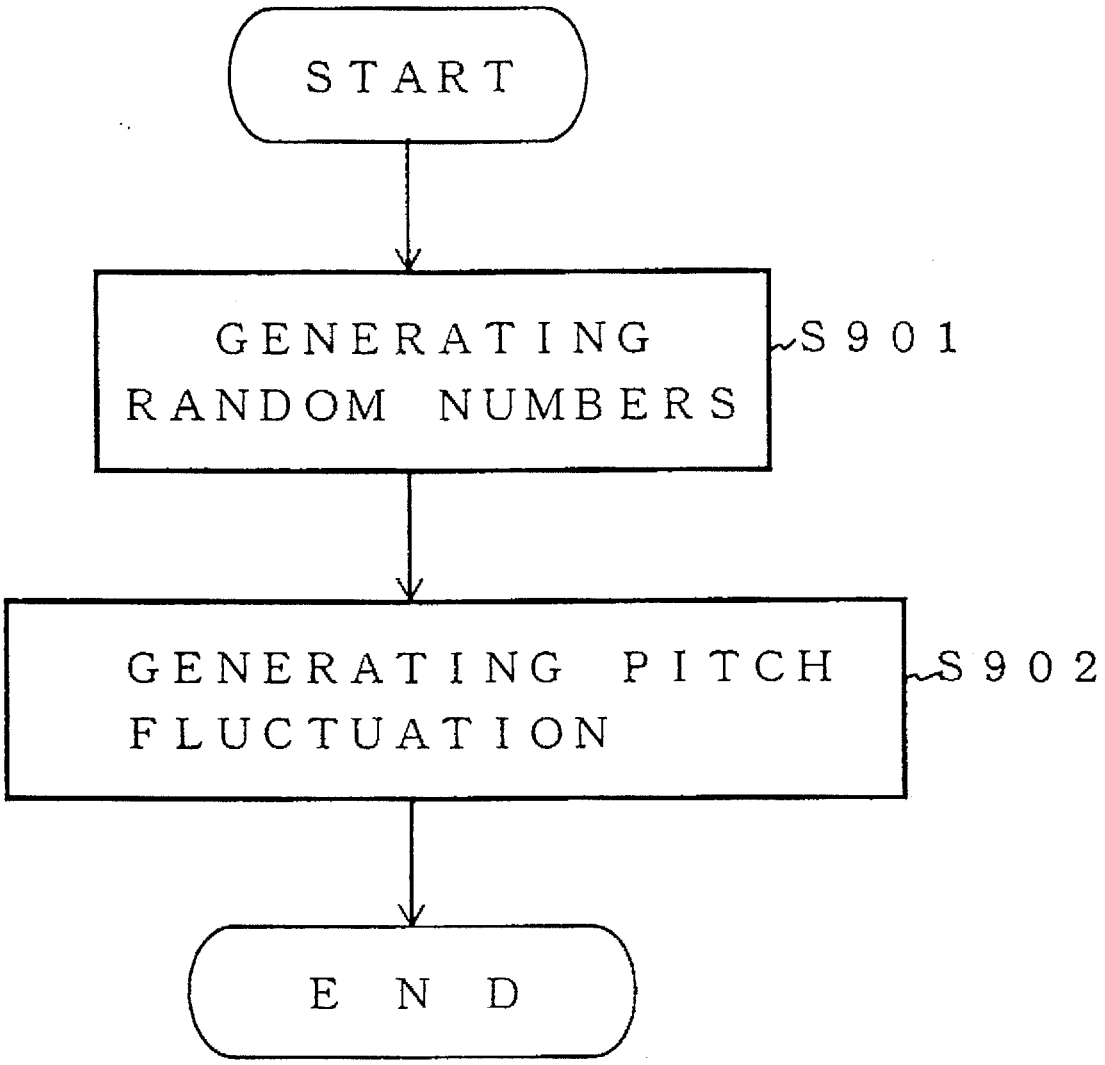
FIG. 31 is a flowchart showing the operation of generating the a pitch fluctuation.

Next, the methods of generating and adding a pitch fluctuation through the pitch information changing unit 107 shown in FIG. 21 are described by referring to the operational flowchart shown in FIG. 31. While the vibrato regularly changes a fundamental frequency, the pitch fluctuation irregularly changes the fundamental frequency. The pitch fluctuation normally indicates a smaller change in a fundamental frequency than the vibrato.

1) Random numbers are generated by the pitch fluctuation information generating unit 73 of the pitch information changing unit 107 shown in FIG. 21. As described later, the random numbers are used when it is determined to which point in a constant fundamental frequency a pitch fluctuation is added, and when the amplitude of the above described modulation signal, that is, the frequency modulation, is determined (step S 901).

2) A pitch fluctuation is generated. According to the random numbers generated in the previous step, a pitch fluctuation is generated with a modulation determined and output to the pitch fluctuation generating unit 3134 (step S 902).

The pitch fluctuation generating unit 3134 adds a frequency fluctuation to the fundamental frequency which has been provided with portamento and vibrato.

Thus, an irregular frequency modulation which should be distinguished from vibrato can be added to the fundamental frequency of a singing voice signal.

Figure 32:
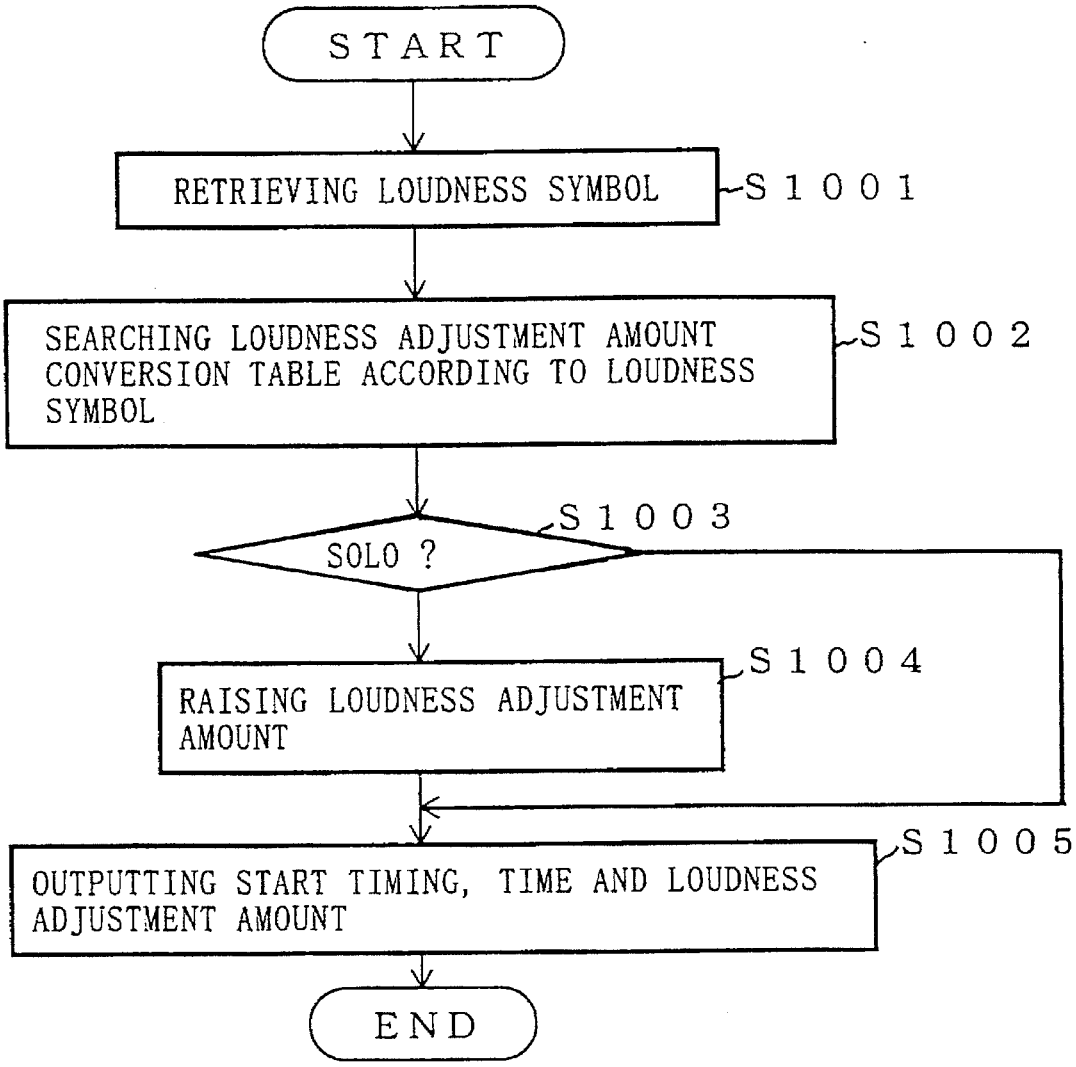
FIG. 32 is a flowchart showing the operation of adjusting the loudness.

Then, the operation of adjusting the loudness of a solo in which a specific voice part in a chorus gives a performance is described by referring to the operational flowchart shown in FIG. 32.

1) A loudness symbol indicating the loudness of sound is fetched from music information (step S 1001).

2) The loudness adjustment amount is retrieved from the fetched loudness symbol. The loudness adjustment amount is stored in a conversion table and the loudness adjustment amount corresponding to the loudness symbol is retrieved (step S 1002).

3) Then, it is determined whether or not the voice part being processed indicates a solo. It is determined to be a solo if the music information for all the other voice parts indicates rest symbols. Control is passed to the next step S 1004 if the present voice part performs a solo. Control is passed to step S 1005 if it does not perform solo.

Figure 33:
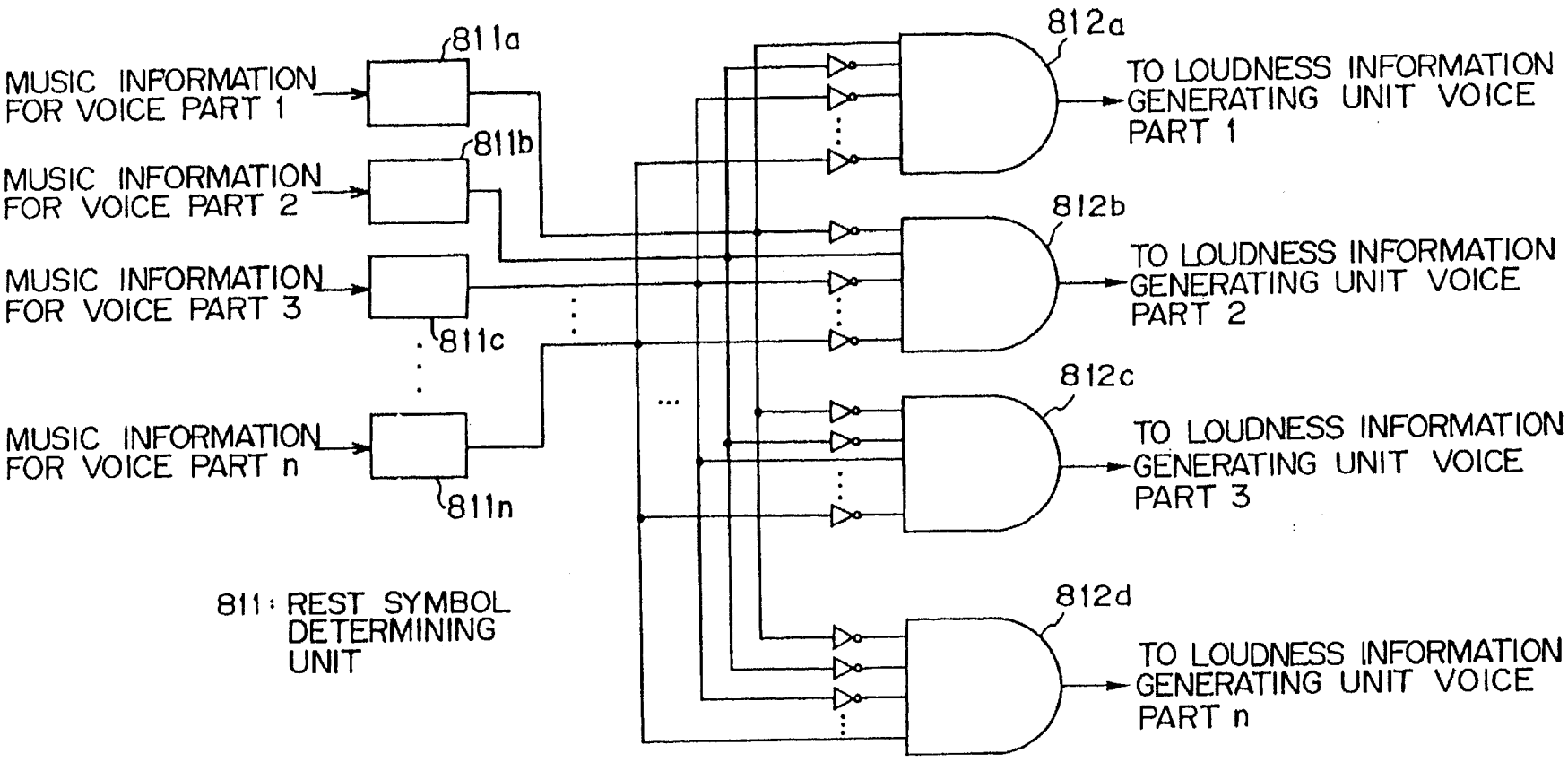
FIG. 33 shows the circuit of the solo detecting unit.

FIG. 33 shows an example of a circuit for determining whether or not the present voice part plays solo. In FIG. 33, the music information of respective voice parts are input to rest symbol determining units 811*a*, 811*b*, 811*c*, . . . , 811*n*. The rest symbol determining unit 811 outputs 0 if it determines a rest, and outputs "1" if it does not determine a rest. For example, if voice part 1 is not assigned a rest, but all the other voice parts are assigned rests, then AND gate 812*a* outputs "1". As a result, voice part 1 is determined to perform a solo (step S 1003), and the loudness adjustment amount for voice part 1 is increased (step S 1004). AND gates 821*b*, 821*c*, and 821*d* output "0", and the loudness adjustment amount of voice parts 2, 3, and 4 remains the same.

4) The start timing of loudness adjustment and adjustment time are retrieved from the music information. The loudness adjustment amount generated in the previous step is added or subtracted to or from a reference loudness for a specified time from the start timing (step S 1005).

The singing voice signal generating unit 1032 shown in FIG. 19 synthesizes a singing voice from the generated fundamental frequency, loudness information, note length, and phonetic symbol using a voice synthesizing device by the PARCOR method, etc..

Figure 25:
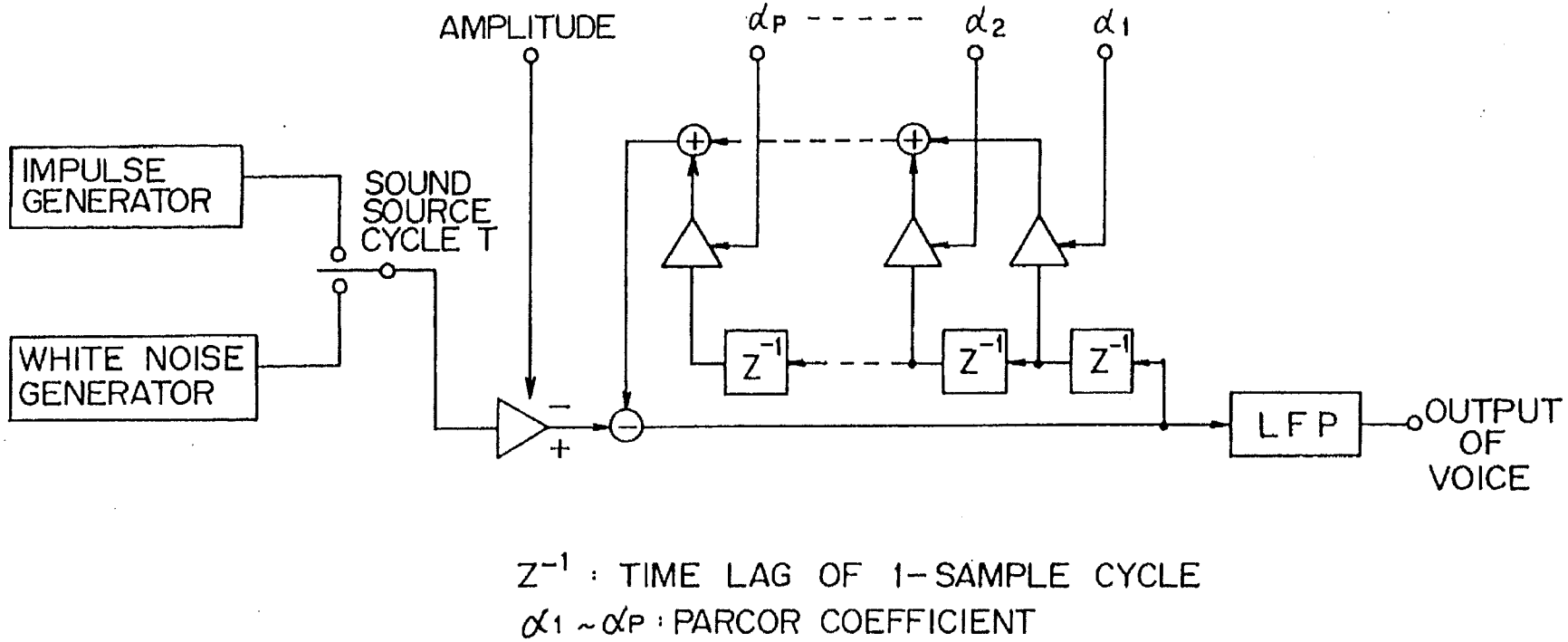
FIG. 25 shows the configuration of the singing voice signal generating unit (PARCOR synthesizing device)

FIG. 25 shows an example of the singing voice signal generating unit 1032 and shows the configuration of the PARCOR synthesizing device.

The information necessary for the PARCOR synthesizing device to synthesize singing voices is sound source amplitude A, sound source cycle T and the PARCOR coefficients. The loudness of a voice is determined by sound source amplitude A. The present invention uniquely obtains sound source amplitude A according to the loudness information generated by the loudness information generating unit 10314 (FIG. 20). Furthermore, sound source cycle T determines the pitch of a voice. The present invention uniquely obtains the fundamental frequency of a voice according to a fundamental frequency pattern after being provided with portamento, vibrato, pitch fluctuation, etc. generated by the pitch information generating unit 10313 shown in FIG. 20.

The PARCOR coefficient can be obtained by the autocorrelation function method. Assuming that one frame is assigned 20 ms (50 frames per second), the number of PARCOR coefficients is 10, and each coefficient is represented with 10 bits, a voice can be regenerated with the information amount of 10×10×50=5000 bps for one second. When vowels such as "a", "i", "u", "e", "ou", etc. are regenerated, different PARCOR coefficients are required and stored.

A pulse is generated by an impulse generator shown in FIG. 25, and is obtained with a sound source amplitude A and a sound source cycle T. As explained above, the pulse can be defined by a fundamental frequency, loudness information, and the size of phoneme (timing). The impulse generator is selected when a vowel is regenerated. Assuming that the fundamental frequency is 250 Hz and the sample cycle is 8 kHz, then a pulse having a pulse width of 125 μs and a period of 4 ms is generated. The amplitude of a pulse depends on loudness information.

A pulse is also generated by a white noise generator shown in FIG. 25. It is generated at random and selected when a consonant is regenerated.

A signal having a voice spectrum is generated by a filter unit. $\alpha 1$, $\alpha 2$, $\alpha 3$, . . . , $\alpha p$ are PARCOR coefficients. For example, if "a" is to be regenerated, then coefficients corresponding to "a" in the PARCOR coefficients are sequentially entered every 20 ms, regenerated as a voice spectrum corresponding to "a", and output through a low-pass filter LPF. A similar process is performed for consonants. Therefore, a PARCOR coefficient selected from a phonetic symbol generated from voice information is updated every 20 ms corresponding to 1 frame for a period represented by note length, and a voice spectrum is output. A singing voice can be regenerated by repeatedly performing the above described process with a phonetic symbol and phoneme size sequentially read.

A singing voice signal is generated as a synthesized voice waveform by the singing voice signal synthesizing unit 1032 of singing voice signal generating units 103A through 103*c*. The singing voice signals are added up in the chorus signal generating unit 104, converted for output into analog signals by a D/A converter not shown in the attached drawings.

A chorus signal is generated by the chorus generating unit 104 and output as actual singing voices by the singing voice output unit 105 (for example, a speaker through an amplifier).

Although the PARCOR synthesizing device is used in the embodiment of the present invention, it is obvious that the voice synthesizing device is not limited to a PARCOR system, but can be an LSP (linear-spectrum pair) system, a waveform editing system, a format synthesizing system, etc.

In the present embodiment, a plurality of voice parts form a chorus. However, the present invention is not limited to a chorus, but can be realized as a singing voice generating device for a unison.

In this case, natural singing voices can be realized as a unison by assigning the same music information and word information to a plurality of voice parts, providing different note lengths and a fundamental frequency for respective singing voice parts, and adding vibrato, portamento, or pitch fluctuation.

The present invention generates voice parts forming a chorus such that they have respective fundamental frequency and note lengths slightly different from one another. When the pitch of a singing voice shows a change, a kind of portamento has been added to obtain a smooth change, not a discontinuous change according to the conventional technologies. According to the present invention, a timing of adding portamento, a portamento parameter indicating the degree of frequency change, etc. through portamento, or different portamento for each voice part can be added to a singing voice signal of each voice part.

Furthermore, various vibrato parameters such as a vibrato start timing, vibrato fluctuation frequency, and vibrato amplitude, etc. are added to respective singing voice parts. According to the present invention, the vibrato is not so simple as in the conventional technologies. For example, the effect of vibrato can be gradually increased during a given period of singing with an equal pitch.

Moreover, fluctuation can be generated based on random numbers to subtly change a fundamental frequency, or the above described portamento or vibrato parameters can be irregularly changed as in an actual chorus.

Additionally, when a single voice part is giving a solo in a 4-part chorus, for example, and the other three voice parts are assigned rests, the loudness shows a low level in the conventional technologies, while the entire decrease in loudness can be prevented according to the present invention.

Thus, the singing voice synthesizing device according to the present invention synthesizes singing voices in a chorus or a unison which sounds natural and not mechanical as in the conventional technologies.

What is claimed is:

1. A singing voice synthesizing device which synthesizes a singing voice of a song in a chorus comprising:

music/word information input means for entering music information and word information of the song;

part extracting means for extracting the music information and the word information of the chorus for each voice part in the chorus;

note length information changing means for changing for each voice part note length information included in the music information extracted for each voice part by generating a random number and assigning the random number to a note length change amount in accordance with different rules for each voice part;

a plurality of singing voice signal synthesizing means for synthesizing singing voice signals based on the music information extracted for each voice part, the word information extracted for each voice part, and the note length information charged by said note length information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

2. A singing voice synthesizing device which synthesizes a singing voice of a song in a chorus comprising:

music/word information input means for entering music information and word information of the song;

part extracting means for extracting the music information and the word information of the chorus for each voice part in the chorus;

note length information changing means for changing for each voice part note length information included in the music information extracted for each voice part, said note length information changing means generates a random number, so that a change amount is determined according to the generated random number if an accumulated change amount for each voice part does not exceed a predetermined allowable value, and generates a signal designating no change amount, if the accumulated change amount for each voice part exceeds the predetermined allowable value, and comprising;

means for adding either one of said random number and said signal designating no change amount to the note length information;

a plurality of singing voice signal synthesizing means for synthesizing singing voice signals based on the music information extracted for each voice part, the word information extracted for each voice part, and the note length information charged by said note length information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

3. A singing voice synthesizing device which synthesizing a singing voice of a song in a chorus comprising:

music/word information input means for entering music information and word information of the song;

part extracting means for extracting the music information and word information of the chorus for each voice part in the chorus;

pitch information changing means for changing for each voice part pitch information included in the music information extracted for each voice part by assigning the pitch information an irregular frequency fluctuation in accordance with different rules for each voice part;

a plurality of singing voice signal synthesizing means for synthesizing singing voice signals based on the music information extracted for each voice part, the word information extracted for each voice part, and the pitch information changed by said pitch information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

4. The singing voice synthesizing device according to claim 3, wherein said pitch information changing means changes a parameter for use in generating portamento to be added to a fundamental frequency of the singing voice signal, and further comprising means for generating said portamento based on said parameter.

5. The singing voice synthesizing device according to claim 4, wherein said pitch information changing means generates a random number and determines a change amount of the parameter according to the random number.

6. The singing voice synthesizing device according to claim 3, wherein said pitch information changing means changes a parameter for use in generating vibrato to be added to a fundamental frequency of the singing voice signal, and further comprising means for generating said vibrato based on said parameter.

7. The singing voice synthesizing device according to claim 6, wherein said pitch information changing means generates a random number and determines a change amount of the parameter according to the random number.

8. A singing voice synthesizing device which synthesizing a singing voice of a song in a chorus comprising:

music/word information input means for entering music information and word information of the song;

part extracting means for extracting the music information and word information of the chorus for each voice part in the chorus;

pitch information changing means for changing for each voice part pitch information included in the music information extracted for each voice part and for adding an irregular frequency fluctuation to a fundamental frequency of the singing voice signal;

a plurality of singing voice signal synthesizing means for synthesizing singing voice signals based on the music information extracted for each voice part, the word information extracted for each voice part, and the pitch information changed by said pitch information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

9. The singing voice synthesizing device according to claim 8, wherein said pitch information changing means determines the pitch fluctuation by generating a random number and adds the pitch fluctuation to the fundamental frequency of the singing voice signal.

10. A singing voice synthesizing device which synthesizes a singing voice of a song in a chorus comprising:

music/word information input means for entering music information and word information of the song;

part extracting means for extracting the music information and the word information of the chorus for each voice part in the chorus;

a plurality of singing voice signal synthesizing means for synthesizing singing voice signals based on the music information extracted for each voice part, and the word information extracted for each voice part;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means, wherein said singing voice signal synthesizing means comprises:

basic pitch generating means for generating a basic frequency based on the music information extracted for each voice part;

portamento parameter change amount generating means for changing for each voice part a parameter for use in generating portamento to be added to the basic frequency generated by said basic pitch generating means;

vibrato parameter change amount generating means for changing for each voice part a parameter for use in generating vibrato to be added to the basic frequency generated by said basic pitch generating means;

pitch fluctuation information generating means for generating, for each voice part, information for use in generating irregular frequency fluctuation to be added to the basic frequency generated by said basic pitch generating means;

portamento generating means for generating portamento using the parameter for use in generating the portamento changed for each voice part, and for adding the portamento to the basic frequency;

vibrato generating means for generating vibrato using the parameter for use in generating the vibrato changed for each voice part, and for adding the vibrato to the basic frequency provided with the portamento; and pitch fluctuation generating means for generating irregular frequency fluctuation using the information for use in generating the irregular frequency fluctuation generated for each voice part, and for adding the irregular frequency to the basic frequency provided with the vibrato.

11. A singing voice synthesizing device which synthesizes a singing voice of a song in a chorus comprising:

music/word information input means for entering music information and word information of the song;

part extracting means for extracting the music information and the word information of the chorus for each voice part in the chorus;

loudness information changing means for detecting a performance section in which a specified voice part gives a performance in the chorus, and changing loudness information of the specified voice part so that the specified voice part is emphasized in comparison with another voice part;

a plurality of singing voice signal synthesizing means for synthesizing singing voice signals based on the music information extracted for each voice part, and the word information extracted for each voice part, and the loudness information changed by said loudness information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

12. The singing voice synthesizing device according to claim 11, wherein said specified voice part comprises a solo part.

13. The singing voice synthesizing device according to claim 11, wherein said loudness information changing means raises loudness of the specified voice part.

14. The singing voice synthesizing device according to claim 11, wherein said loudness information changing means detects a rest in the music information extracted for each voice part and detects the specified voice part.

15. A singing voice synthesizing device which synthesizes a singing voice of a song in a chorus comprising:

music/word information input means for entering music information and word information of the song;

part extracting means for extracting the music information and the word information of the chorus for each voice part in the chorus;

loudness information changing means for detecting a performance section in which a specified voice part gives a performance in the chorus, and changing loudness information of the specified voice part, said loudness information changing means comprising:

a plurality of rest symbol determining means for determining whether or not the music information extracted for each voice part indicates a rest symbol, and outputting a determination result; and a logical gate for detecting a solo part from the result output by said plurality of rest symbol determining means;

a plurality of singing voice signal synthesizing means for synthesizing singing voice signals based on the music information extracted for each voice part, and the word information extracted for each voice part, and the loudness information changed by said loudness information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

16. A singing voice synthesizing device which synthesizes a singing voice of a song in a chorus comprising:

music/word information input means for entering music information and word information of the song;

part extracting means for extracting the music information and the word information of the chorus for each voice part in the chorus;

note length information changing means for changing for each voice part note length information included in the music information extracted for each voice part by generating a random number and assigning the random number to a note length change amount in accordance with different rules for each voice part;

pitch information changing means for changing for each voice part pitch information included in the music information extracted for each voice part by assigning the pitch information an irregular frequency fluctuation in accordance with different rules for each voice part;

loudness information changing means for detecting a performance section in which a specified voice part gives a performance in the chorus, and changing loudness information of the specified voice part;

a plurality of singing voice signal synthesizing means for synthesizing singing voice signals based on the music information extracted for each voice part, the word information extracted for each voice part, the note length information changed by said note length information changing means, the pitch information changed by said pitch information changing means, and loudness information changed by said loudness information changing means;

chorus signal generating means for generating a singing voice signal of the chorus from singing voice signals synthesized by said plurality of singing voice synthesizing means; and singing voice output means for generating a singing voice from singing voice signals of the chorus generated by said chorus signal generating means.

* * * * *